US010504470B2

(12) United States Patent
Kawashima et al.

(10) Patent No.: US 10,504,470 B2
(45) Date of Patent: Dec. 10, 2019

(54) DRIVING METHOD OF DISPLAY DEVICE

(71) Applicant: Semiconductor Energy Laboratory Co., Ltd., Atsugi-shi, Kanagawa-ken (JP)

(72) Inventors: Susumu Kawashima, Kanagawa (JP); Hidetomo Kobayashi, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 15/888,630

(22) Filed: Feb. 5, 2018

(65) Prior Publication Data

US 2018/0226041 A1 Aug. 9, 2018

(51) Int. Cl.
*G09G 3/36* (2006.01)

(52) U.S. Cl.
CPC ... *G09G 3/3677* (2013.01); *G09G 2310/0213* (2013.01); *G09G 2310/04* (2013.01); *G09G 2320/0219* (2013.01); *G09G 2320/0295* (2013.01)

(58) Field of Classification Search
CPC ..... G06F 3/1446; G09G 2310/0286; G09G 2310/0213; G09G 2320/0295; G09G 2320/0233; G09G 3/3688; G09G 3/3648; G09G 3/3696; G09G 2310/0205; G09G 3/3633
See application file for complete search history.

(56) References Cited

U.S. PATENT DOCUMENTS 7,414,671 B1 * 8/2008 Gallagher ..... H04N 7/012 348/625
2007/0072439 A1 3/2007 Akimoto et al.
2009/0009452 A1 * 1/2009 Sunohara ..... G09G 3/3688 345/87
2011/0090183 A1 4/2011 Yamazaki et al.
2011/0102409 A1 5/2011 Hayakawa

FOREIGN PATENT DOCUMENTS

JP 2007-123861 A 5/2007
JP 2011-120221 A 6/2011
JP 2011-141522 A 7/2011

* cited by examiner

*Primary Examiner* — Gerald Johnson
(74) *Attorney, Agent, or Firm* — Fish & Richardson P.C.

(57) ABSTRACT

Display quality is improved. A display device includes a display controller and a display panel provided with m×n pixels. The display controller includes the step of comparing first display data, which is displayed in a first pixel connected to the i-th signal line and the (j−1)-th scan line, with second display data, which is displayed in a second pixel connected to the i-th signal line and the j-th scan line, and calculating an absolute value of a difference value, the step of extracting a maximum value from a result of the absolute value, and the step of determining a first selection period of the j-th scan line in accordance with the maximum value.

14 Claims, 18 Drawing Sheets

DRIVING METHOD OF DISPLAY DEVICE

BACKGROUND OF THE INVENTION

1. Field of the Invention

One embodiment of the present invention relates to a method for driving a display device.

Note that one embodiment of the present invention is not limited to the above technical field. The technical field of one embodiment of the invention disclosed in this specification and the like relates to an object, a method, or a manufacturing method. The present invention relates to a process, a machine, manufacture, or a composition of matter. In particular, one embodiment of the present invention relates to a semiconductor device, a display device, a light-emitting device, a power storage device, a memory device, a driving method thereof, or a manufacturing method thereof.

Note that in this specification and the like, a semiconductor device refers to an element, a circuit, a device, or the like that can function by utilizing semiconductor characteristics. An example of the semiconductor device is a semiconductor element such as a transistor or a diode. Another example of the semiconductor device is a circuit including a semiconductor element. Another example of the semiconductor device is a device provided with a circuit including a semiconductor element.

2. Description of the Related Art

Display devices are incorporated in mobile electronic devices such as smartphones, tablets, and e-book readers, and also incorporated in electronic devices such as monitors, TVs, and digital signages. The display devices used in electronic devices have the need to display high-resolution images. Furthermore, long-term use is required for mobile electronic devices. The electronic devices also need to be used at low power.

In display devices, thin film transistors with the same conductivity are typically used for a driver circuit. An example of such a structure is disclosed in Patent Document 1.

A metal oxide, a semiconductor material that can be applied to a transistor, has attracted attention as a technique for achieving lower power consumption. For example, Patent Document 2 discloses a technique for fabricating a transistor with use of a metal oxide such as zinc oxide or an In—Ga—Zn-based oxide. A transistor including a semiconductor layer made of a metal oxide is referred to as an OS transistor.

The OS transistor has an extremely low off-state current. With use of this, Patent Document 3 discloses a technique for reducing the refresh rate in displaying a still image so that the power consumption of a liquid crystal display can be reduced. Note that in this specification, the technique for reducing the power consumption of the display device is referred to as idling stop driving or IDS driving.

REFERENCE

Patent Document

[Patent Document 1] Japanese Published Patent Application No. 2011-120221

[Patent Document 2] Japanese Published Patent Application No. 2007-123861

[Patent Document 3] Japanese Published Patent Application No. 2011-141522

SUMMARY OF THE INVENTION

Display devices in electronic devices have been increasingly used in medical equipment and the like. The display devices used in medical equipment have improved resolution, allowing a slight change to be recognized from displayed content and leading to early detection of lesions. However, a display device with a high resolution includes a large number of pixels. An increased number of pixels requires a large amount of display data for display updating, causing a shortage of time for display updating.

A display device with a higher resolution, which includes a larger number of pixels, consumes more power for updating data. In addition, in a display module including a touch panel as well as the display device, display updating interferes the touch panel when it is performed at the same time as touch sensing of the touch panel, which reduces the accuracy of touch sensing.

Still images are usually used in electronic devices with high resolutions such as digital signages. In the display devices, successive rows are repeatedly displayed with the same display data in some cases. However, even when a plurality of rows are displayed with the same display data, power is consumed for display updating in the display devices.

In view of the above problems, an object of one embodiment of the present invention is to provide a display device with a novel structure. Another object of one embodiment of the present invention is to provide a display device that adjusts a period for selecting a scan line in accordance with data for display updating. Another object of one embodiment of the present invention is to provide a display device with improved display quality. Another object of one embodiment of the present invention is to provide an electronic device with reduced power consumption.

Note that the descriptions of these objects do not disturb the existence of other objects. In one embodiment of the present invention, there is no need to achieve all the above objects. Other objects will be apparent from and can be derived from the description of the specification, the drawings, the claims, and the like.

Note that the objects of one embodiment of the present invention are not limited to the above objects. The objects described above do not disturb the existence of other objects. The other objects are the ones that are not described above and will be described below. The other objects that are not described above will be apparent from and can be derived from the description of the specification, the drawings, and the like by those skilled in the art. Note that one embodiment of the present invention is to solve at least one of the aforementioned objects and the other objects.

One embodiment of the present invention is a driving method of a display device including a display controller and a display panel provided with first to m-th signal lines, first to n-th scan lines, and a plurality of pixels arranged at intersection points of the scan lines and the signal lines. The display controller includes the step of comparing first display data, which is displayed in a first pixel connected to the m-th signal line and the (n−1)-th scan line, with second display data, which is displayed in a second pixel connected to the m-th signal line and the n-th scan line, and calculating an absolute value of a difference value, the step of extracting a maximum value from a result of the absolute value, and the step of determining a first selection period of the n-th scan line in accordance with the maximum value.

In the driving method of a display device with the above structure, the display controller preferably includes the step of determining, from results of a plurality of absolute values, that the first display data is the same as the second display data, the step of concurrently selecting the (n−1)-th scan line and the n-th scan line after determining that the first display data is the same as the second display data, and the step of concurrently updating the first pixel and the second pixel, which are connected to the m-th signal line, with the first display data.

In any of the driving methods of a display device with the above structures, preferably, the signal line further includes parasitic capacitance and the display controller includes the step of concurrently selecting the (n−1)-th scan line and the n-th scan line, the step of supplying the first display data to the first pixel and the second pixel, which are connected to the m-th signal line, and the parasitic capacitance included in the m-th signal line, the step of deselecting the (n−1)-th scan line, the step of supplying the difference value to the m-th signal line when the n-th scan line is selected, and the step of reducing a writing period of data for updating the second pixel.

In any of the driving methods of a display device with the above structures, preferably, the display controller includes the step of dividing the first selection period in accordance with the extracted maximum value, the step of comparing the first selection period with a second selection period calculated by dividing one frame period by the number of scan lines, and the step of determining that the first selection period is shorter than the second selection period.

In any of the driving methods of a display device with the above structures, preferably, the display controller includes the step of dividing the first selection period in accordance with the extracted maximum value, the step of comparing the first selection period with a second selection period calculated by dividing one frame period by the number of scan lines, and the step of determining that the first selection period is longer than the second selection period.

In any of the driving methods of a display device with the above structures, the display panel preferably includes a transistor and the transistor preferably includes polycrystalline silicon in a semiconductor layer.

In any of the driving methods of a display device with the above structures, the display panel preferably includes a transistor and the transistor preferably includes a metal oxide in a semiconductor layer.

In any of the driving methods of a display device with the above structures, the display panel preferably includes a transistor and the transistor preferably includes a backgate.

According to one embodiment of the present invention, a display device with a novel structure can be provided. According to another embodiment of the present invention, a display device that adjusts a period for selecting a scan line in accordance with data for display updating can be provided. According to another embodiment of the present invention, a display device with improved display quality can be provided. According to another embodiment of the present invention, an electronic device with reduced power consumption can be provided.

Note that the effects of one embodiment of the present invention are not limited to the above effects. The effects described above do not disturb the existence of other effects. The other effects are the ones that are not described above and will be described below. The other effects that are not described above will be apparent from and can be derived from the description of the specification, the drawings, and the like by those skilled in the art. Note that one embodiment of the present invention is to have at least one of the aforementioned effects and the other effects. Therefore, one embodiment of the present invention does not have the effects described above in some cases.

DETAILED DESCRIPTION OF THE INVENTION

Figure 1:
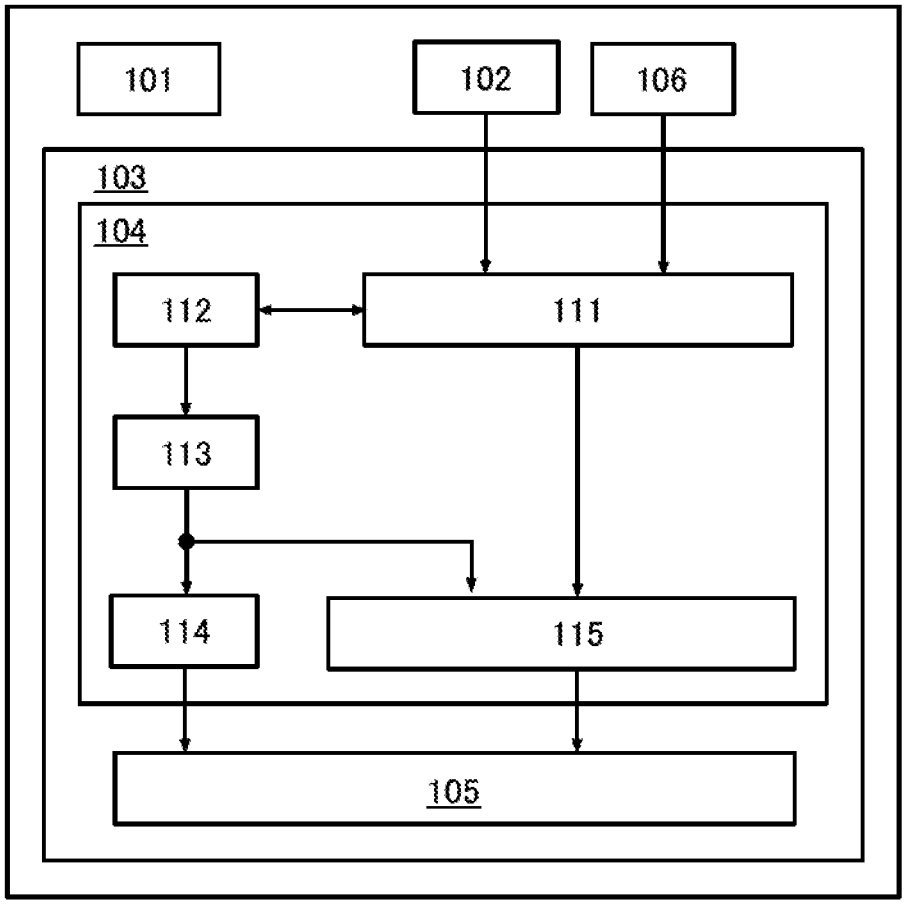
FIG. 1 illustrates a configuration of an electronic device.

Hereinafter, embodiments will be described with reference to drawings. However, the embodiments can be implemented in many different modes, and it will be readily appreciated by those skilled in the art that modes and details thereof can be changed in various ways without departing from the spirit and scope of the present invention. Therefore, the present invention should not be interpreted as being limited to the description of the embodiments below.

In the drawings, the size, the layer thickness, or the region is exaggerated for clarity in some cases, and therefore, is not limited to the illustrated scale. Note that the drawings are schematic views showing ideal examples, and embodiments of the present invention are not limited to shapes or values shown in the drawings.

Note that in this specification, ordinal numbers such as "first", "second", and "third" are used in order to avoid confusion among components, and the terms do not limit the components numerically.

Also in this specification, terms for explaining arrangement, such as "over" and "under", are used for convenience to describe the positional relation between components with reference to drawings. The positional relation between components is changed as appropriate in accordance with a direction in which each component is described. Thus, the positional relation is not limited to that described with a term used in this specification and can be explained with the other terms as appropriate depending on the situation.

In this specification and the like, a transistor is an element having at least three terminals, a gate, a drain, and a source. The transistor has a channel formation region between the drain (a drain terminal, a drain region, or a drain electrode) and the source (a source terminal, a source region, or a source electrode), and current can flow between the source and the drain through the channel formation region. Note that in this specification and the like, a channel formation region refers to a region through which current mainly flows.

Furthermore, functions of a source and a drain might be switched when a transistor of opposite polarity is employed or a direction of current flow is changed in circuit operation, for example. Therefore, the terms "source" and "drain" can be switched in this specification and the like.

In this specification and the like, the term "electrically connected" includes the case where components are connected through an "object having any electric function". There is no particular limitation on the "object having any electric function" as long as electric signals can be transmitted and received between components that are connected through the object. Examples of the "object having any electric function" include a switching element such as a transistor, a resistor, an inductor, a capacitor, and an element with a variety of functions as well as an electrode and a wiring.

In this specification and the like, the term "parallel" indicates that the angle formed between two straight lines is greater than or equal to −10° and less than or equal to 10°, and accordingly also includes the case where the angle is greater than or equal to −5° and less than or equal to 5°. The term "perpendicular" indicates that the angle formed between two straight lines is greater than or equal to 80° and less than or equal to 100°, and accordingly also includes the case where the angle is greater than or equal to 85° and less than or equal to 95°.

In this specification and the like, the terms "film" and "layer" can be interchanged with each other. For example, the term "conductive layer" can be changed into the term "conductive film" in some cases. Also, the term "insulating film" can be changed into the term "insulating layer" in some cases.

Unless otherwise specified, an off-state current in this specification and the like refers to a drain current of a transistor in an off state (also referred to as a non-conducting state and a cutoff state). Unless otherwise specified, the off state of an n-channel transistor means that the voltage between its gate and source ($V_{gs}$) is lower than the threshold voltage Vth, and the off state of a p-channel transistor means that the gate-source voltage $V_{gs}$ is higher than the threshold voltage $V_{th}$. For example, the off-state current of an n-channel transistor sometimes refers to a drain current that flows when the gate-source voltage $V_{gs}$ is lower than the threshold voltage $V_{th}$.

The off-state current of a transistor depends on $V_{gs}$ in some cases. Thus, "the off-state current of a transistor is lower than or equal to I" may mean "there is $V_{gs}$ with which the off-state current of the transistor becomes lower than or equal to I". The off-state current of a transistor may refer to an off-state current at a given $V_{gs}$, at $V_{gs}$ in a given range, at $V_{gs}$ at which a sufficiently low off-state current is obtained, or the like.

As an example, the assumption is made of an n-channel transistor where the threshold voltage Vth is 0.5 V and the drain current is $1\times10^{-9}$ A at a voltage $V_{gs}$ of 0.5 V, $1\times10^{-13}$ A at a voltage $V_{gs}$ of 0.1 V, $1\times10^{-19}$ A at a voltage $V_{gs}$ of −0.5 V, and $1\times10^{-22}$ A at a voltage $V_{gs}$ of −0.8 V. The drain current of the transistor is $1\times10^{-19}$ A or lower at $V_{gs}$ of −0.5 V or at $V_{gs}$ in the range of −0.8 V to −0.5 V; therefore, it can be said that the off-state current of the transistor is $1\times10^{-19}$ A or lower. Since there is $V_{gs}$ at which the drain current of the transistor is $1\times10^{-22}$ A or lower, it may be said that the off-state current of the transistor is $1\times10^{-22}$ A or lower.

In this specification and the like, the off-state current of a transistor with a channel width W is sometimes represented by a current value per channel width W or by a current value per given channel width (e.g., 1 μm). In the latter case, the off-state current may be expressed in the unit with the dimension of current per length (e.g., A/μm).

The off-state current of a transistor depends on temperature in some cases. Unless otherwise specified, the off-state current in this specification may be an off-state current at room temperature, 60° C., 85° C., 95° C., or 125° C. Alternatively, the off-state current may be an off-state current at a temperature at which the reliability of a semiconductor device or the like including the transistor is ensured or a temperature at which the semiconductor device or the like is used (e.g., a temperature in the range of 5° C. to 35° C.). The state in which the off-state current of a transistor is I or lower may indicate that the off-state current of the transistor at room temperature, 60° C., 85° C., 95° C., 125° C., a temperature at which the reliability of a semiconductor device or the like including the transistor is ensured, or a temperature at which the semiconductor device or the like including the transistor is used (e.g., a temperature in the range of 5° C. to 35° C.) is I or lower at a certain $V_{gs}$.

The off-state current of a transistor depends on a voltage Vds between its drain and source in some cases. Unless otherwise specified, the off-state current in this specification may be an off-state current at Vds of 0.1 V, 0.8 V, 1 V, 1.2 V, 1.8 V, 2.5 V, 3 V, 3.3 V, 10 V, 12 V, 16 V, or 20 V. Alternatively, the off-state current may be an off-state current at $V_{ds}$ at which the reliability of a semiconductor device or the like including the transistor is ensured or $V_{ds}$ used in the semiconductor device or the like including the transistor. The state in which the off-state current of a transistor is lower than or equal to I may indicate that the off-state current of the transistor at $V_{ds}$ of 0.1 V, 0.8 V, 1 V, 1.2 V, 1.8 V, 2.5 V, 3 V, 3.3 V, 10 V, 12 V, 16 V, or 20 V, at $V_{ds}$ at which the reliability of a semiconductor device or the like including the transistor is ensured, or at $V_{ds}$ used in the semiconductor device or the like including the transistor is lower than or equal to I at a certain $V_{gs}$.

In the above description of the off-state current, a drain may be replaced with a source. That is, the off-state current sometimes refers to a current that flows through a source of a transistor in the off state.

In this specification and the like, the term "leakage current" sometimes expresses the same meaning as off-state current. In this specification and the like, the off-state current sometimes refers to a current that flows between a source and a drain when a transistor is off, for example.

Note that a voltage refers to a difference between potentials of two points, and a potential refers to electrostatic energy (electric potential energy) of a unit charge at a given point in an electrostatic field. Note that in general, a difference between a potential of one point and a reference potential (e.g., a ground potential) is simply called a potential or a voltage, and a potential and a voltage are used as synonymous words in many cases. Thus, in this specification, a potential may be rephrased as a voltage and a voltage may be rephrased as a potential unless otherwise specified.

Embodiment 1

In this embodiment, a driving method of a display device, which allows high-resolution display, will be described with reference to FIG. 1 to FIG. 9.

FIG. 1 illustrates a configuration of an electronic device 100. The electronic device 100 includes a processor 101, a communication module 102, a display device 103, and an external memory device 106. The display device 103 includes a display controller 104 and a display panel 105. The display controller 104 includes a frame memory 111, an arithmetic circuit 112, a timing control circuit 113, a gate driver 114, and a source driver 115.

The electronic device 100 can receive display data from a network server through the communication module 102 by wired or wireless communication. The display data may be input from the external memory device 106. The external memory device 106 is preferably an HDD, an optical disk, a magnetic disk, a magnetic tape, a nonvolatile memory to which a USB memory can be connected, or an inserted external nonvolatile memory.

The display panel 105 included in the display device 103 includes first to m-th signal lines, first to n-th scan lines, and a plurality of pixels arranged at intersection points of the signal lines and the scan lines; the display device 103 will be described in detail with reference to FIGS. 2A and 2B. Described in this embodiment is an example in which the display panel 105 includes a plurality of pixels and an external IC is used as the gate driver 114 or the source driver 115. In this configuration, the gate driver 114 and the source driver 115 are included in the display controller 104 for convenience of explanation, and m and n are each an integer greater than or equal to 2. Note that in the display panel 105, either or both of the gate driver 114 and the source driver 115 may be formed over the same substrate as the pixels.

The processor 101 can control the communication module 102, the display controller 104, and the external memory device 106. The frame memory 111 included in the display controller 104 can store display data received by the communication module 102 or display data held in the external memory device 106.

The arithmetic circuit 112 can calculate a difference value between first display data of a pixel connected to the (n−1)-th scan line and the m-th signal line and second display data of a pixel connected to the n-th scan line and the m-th signal line. The first and second display data are stored in the frame memory 111. The difference value is calculated for each of the first to m-th columns. The difference value focuses on only a difference between display data, and therefore is converted into an absolute value.

The arithmetic circuit 112 can obtain as m absolute values a difference between the second display data supplied to each pixel connected to the n-th scan line and the first display data supplied to each pixel connected to the (n−1)-th scan line. The arithmetic circuit 112 can extract the maximum value among the m absolute values. The arithmetic circuit 112 can supply the maximum value of the n-th row to the timing control circuit 113.

The timing control circuit 113 can determine a selection period of the n-th scan line from the received maximum value. The timing control circuit 113 can supply the gate driver 114 with a control signal for controlling the selectin period of the n-th scan line. In addition, the timing control circuit 113 can supply the source driver 115 with a period for outputting the display data to the signal line. Accordingly, the source driver 115 can output the display data to the signal line in synchronization with the period in which the gate driver 114 selects the scan line.

Figure 2A:
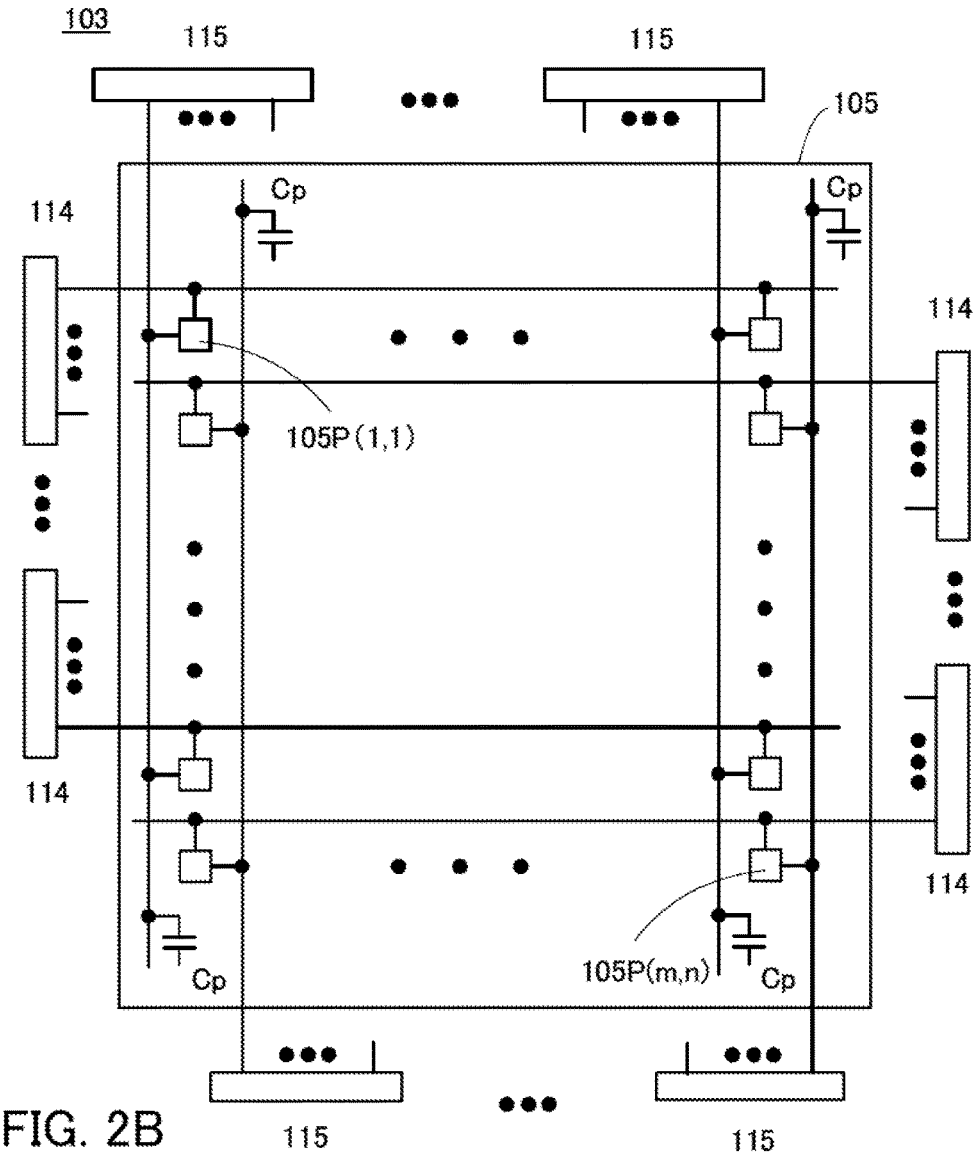
FIG. 2A illustrates a configuration of a display device and FIG. 2B is a circuit diagram of a pixel.

FIG. 2A illustrates a configuration of the display device 103. The display device 103 includes the display panel 105, a plurality of gate drivers 114, and a plurality of source drivers 115. The display panel 105 includes the first to m-th signal lines, the first to n-th scan lines, and pixels 105P(1,1) to 105P(m,n). The pixels 105P are electrically connected to the signal lines and the scan lines.

Figure 2B:
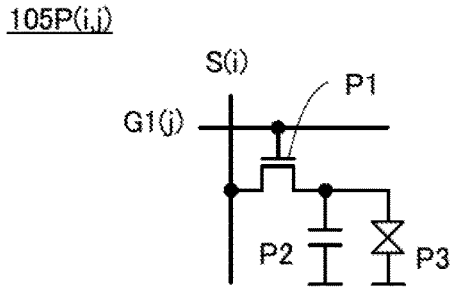

FIG. 2B illustrates an example of a pixel 105P(i,j). The pixel 105P(i,j) includes a selection transistor P1, a capacitor P2, and a display element P3. The display element P3 is preferably a liquid crystal element. Alternatively, the pixel 105P(i,j) may include a light-emitting element as the display element P3. Note that when a light-emitting element is used as the display element P3, a driving transistor is preferably provided in order to control display gray levels. Note that i and j are each a natural number greater than or equal to 1. In the following description, the pixel 105P(i,j) is rephrased as the pixel 105P in some cases.

FIG. 2A shows an example in which the gate drivers 114 on the left of the display panel 105 are electrically connected to odd-numbered scan lines and the gate drivers 114 on the right of the display panel 105 are electrically connected to even-numbered scan lines.

FIG. 2A shows an example in which the source drivers 115 on the top of the display panel 105 are electrically connected to odd-numbered signal lines and the source drivers 115 on the bottom of the display panel 105 are electrically connected to even-numbered signal lines.

The signal line includes regions that overlap with a plurality of scan lines with an insulating layer therebetween; thus, parasitic capacitance Cp is generated. The parasitic capacitance Cp is sufficiently larger than the capacitance of the capacitor P2 included in the pixel 105P. Hence, when display data of the capacitor P2 is updated, the capacitor P2 and the parasitic capacitance Cp need to be charged and discharged as one synthetic capacitor. In particular, the influence of the parasitic capacitance Cp is significant in a display device including 4K (3840×2160), 8K (7680×4320), 16K (15360×8640), or more pixels.

Figure 3A:
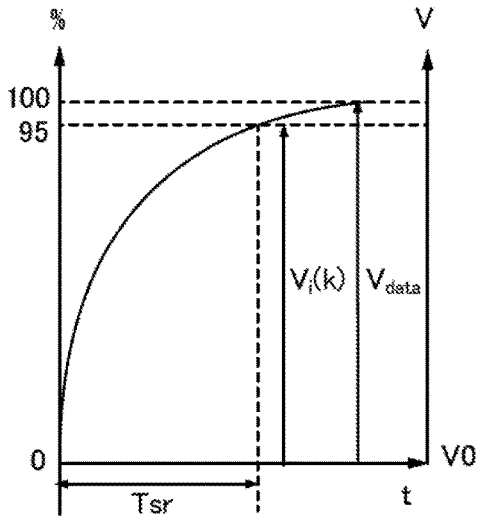
FIGS. 3A and 3B are graphs each showing a change in the potential of a pixel.

FIG. 3A shows an example of a graph that shows a change in the potential of the capacitor P2 included in the pixel 105P at the time when the pixel is updated at a potential Vdata. A rise time Tsr of the potential of the capacitor P2 can be represented by the formula (1). A variable R is a resistance component of a signal line connected to a pixel. A variable Csy is the synthetic capacitance of the capacitor P2 and the parasitic capacitance Cp generated in the signal line. Ratio denotes the achievement degree [%] with respect to the potential Vdata as a potential Vi. Hence, Ratio can be represented by the formula (2).

$$Tsr = R \cdot Csy \cdot \ln(1/(1-\text{Ratio})) \quad (1)$$

$$\text{Ratio} = Vi/V0 \quad (2)$$

The variables are described. Display data Ddata is a digital value stored in the frame memory 111. When supplied to a pixel, the display data is converted into an analog value in the source driver 115, and then converted into a potential Vdata with the analog value. Thus, the display data Ddata with a gray level of 0 has a digital value of "0" and indicates the potential V0 with an analog value.

Figure 3B:
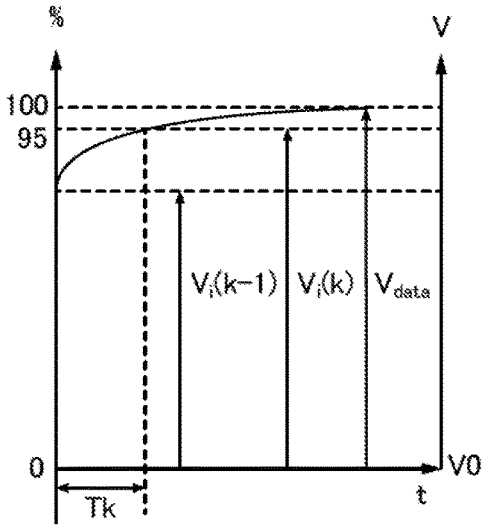

FIG. 3A or 3B shows an example in which Ratio=0.95, that is, the achievement degree of the potential of the capacitor P2 is 95% on the assumption that the degree at which the display data is updated ideally is 1.00. The potential Vi is a potential with respect to the set potential Vdata, which is reached by the capacitor P2 after the rise time Tsr.

FIG. 3A shows an example of a change over time in the potential of the capacitor P2 included in the pixel 105P from V0 to Vdata. In contrast, FIG. 3B shows an example in which the potential Vi(m,k−1) of display data supplied to the pixel 105P(m,k−1) connected to the (k−1)-th scan line and the m-th signal line is already stored in the parasitic capacitance Cp of the signal line. Thus, the potential Vi(m,k) of the display data supplied to the pixel 105P(m,k) of the k-th row is changed from the potential Vi(m,k−1) already stored in the parasitic capacitance Cp, and can have a rise time Tk. In FIGS. 3A and 3B, information of the columns is omitted and the potentials are denoted as Vi(k−1) and Vi(k).

A selection period of the k-th scan line can be represented by the formulae (3) and (4). In the following formulae, variables of the m-th signal line are omitted.

$$Tk(k)=R\cdot Csy\cdot\ln(1-|\mathrm{Ratio}(k)|) \quad (3)$$

$$\mathrm{Ratio}(k)=\{Vi(k)-Vi(k-1)\}/\{Vdata(k)-Vi(k-1)\} \quad (4)$$

That is, the potential Vi(m,k−1) of the display data of the previous stage, which is stored in the parasitic capacitance Cp of the signal line, is utilized as a precharge potential, whereby the rise time Tsr can be shortened. In other words, the rise time Tk can be optimized if the amount of change in display data is obtained. The rise time Tk may be rephrased as a period in which the k-th scan line is selected. Hence, when the amount of change in display data is large, a selection period of a scan line can be long enough for data to be updated.

Figure 4A:
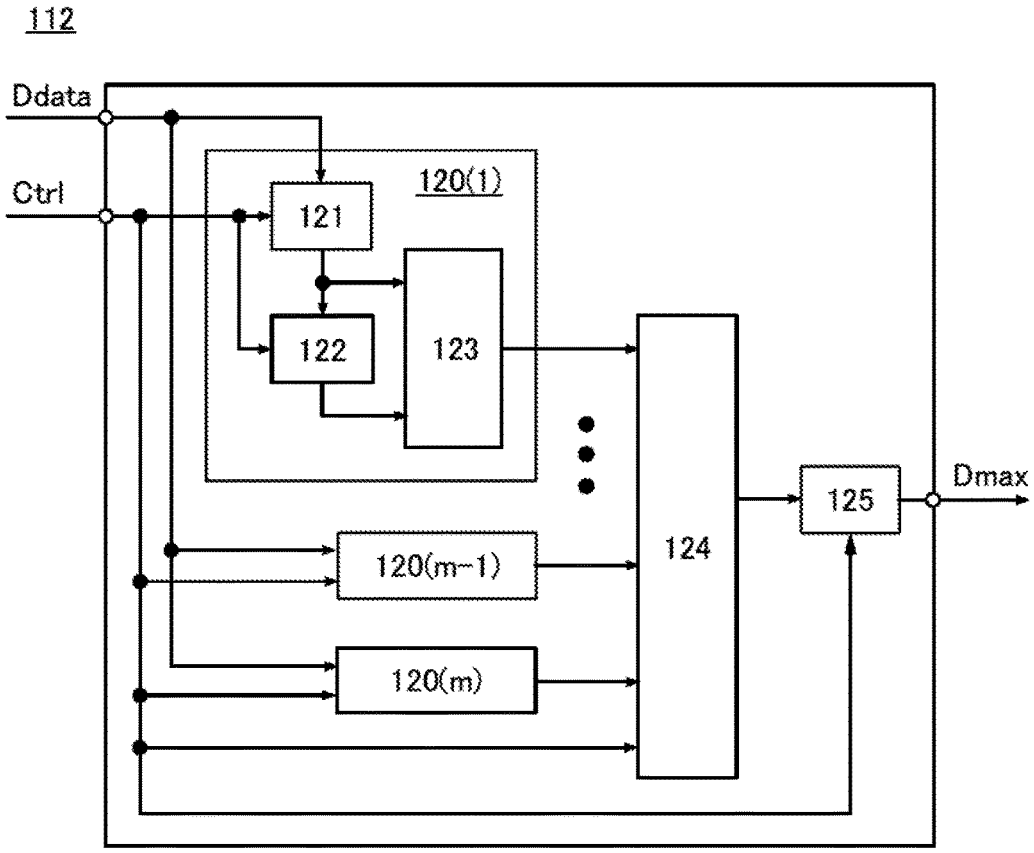
FIGS. 4A and 4B each illustrate a configuration of a display device.

FIG. 4A illustrates a configuration of the arithmetic circuit 112 included in the display controller 104. The arithmetic circuit 112 includes a difference detection circuit 120, a maximum value detection circuit 124, and a latch circuit 125.

The number of difference detection circuits 120 included in the arithmetic circuit 112 is preferably equal to the number of signal lines. The difference detection circuit 120 includes a first latch circuit 121, a second latch circuit 122, and a subtraction circuit 123. In the first latch circuit, display data Ddata(m,k−1) of the (k−1)-th row and the m-th column is stored by a control signal Ctrl. Then, display data Ddata (m,k) of the k-th row and the m-th column is supplied to the first latch circuit by the control signal Ctrl; at that time, the output of the first latch circuit is stored in the second latch circuit 122.

The subtraction circuit 123 calculates a difference value between the output of the first latch circuit and the output of the second latch circuit, whereby a difference value can be obtained. The calculated difference value is converted into an absolute value and supplied to the maximum value detection circuit 124.

The maximum value detection circuit 124 can extract a maximum value Dmax among the m difference values converted into absolute values. The extracted maximum value Dmax of the k-th row is stored in the latch circuit 125. An output of 0 from the maximum value Dmax indicates that there is no change between display data of the k-th row, Ddata(1,k) to Ddata(m,k), and display data of the (k−1)-th row, Ddata(1,k−1) to Ddata(m,k−1).

Figure 4B:
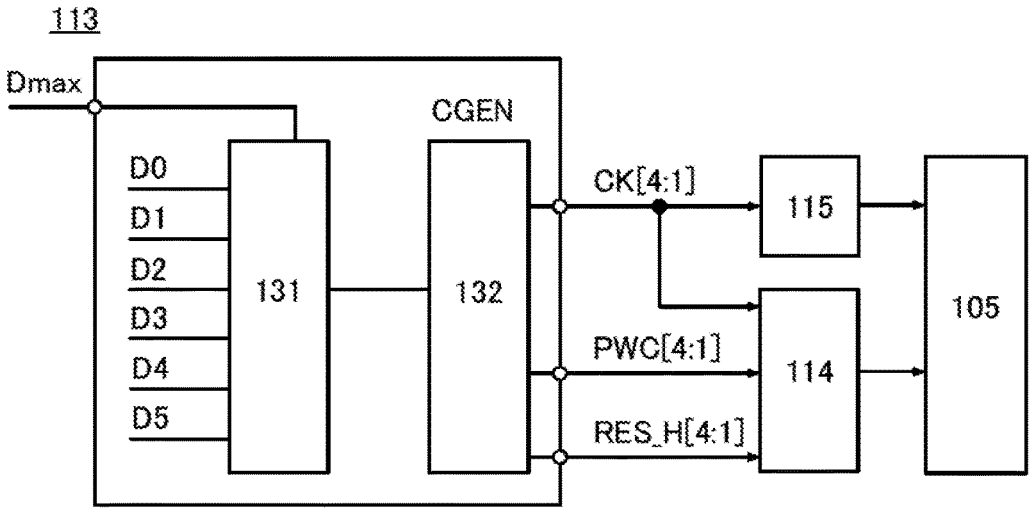

FIG. 4B illustrates a configuration of the timing control circuit 113. The timing control circuit 113 includes a selection circuit 131 and a clock generation circuit 132.

The maximum value Dmax calculated by the arithmetic circuit 112 is supplied to the selection circuit 131. The maximum value Dmax is divided into a plurality of categories. For example, in FIG. 4B, the maximum value Dmax is divided into six categories of D0 to D5. In the case where 8-bit data is displayed with 256 gray levels, the category D1 includes the calculated maximum values Dmax of 1 to 50; the category D2 includes the calculated maximum values Dmax of 51 to 100; the category D3 includes the calculated maximum values Dmax of 101 to 150; the category D4 includes the calculated maximum values Dmax of 151 to 200; and the category D5 includes the calculated maximum values Dmax of 201 to 255. The category D0 is specified when the calculated maximum value Dmax is 0, i.e., when there is no change in display data.

The number of categories is six in the above example. However, the number of categories is not limited to six and may be five or less or seven or more. Alternatively, 256 categories may be provided so as to correspond to the above display data with 256 gray levels.

The selection period of a scan line can be determined by each category. The selection circuit 131 can supply the clock generation circuit 132 with information on the category including the maximum value Dmax. With use of the category information, the clock generation circuit 132 can generate a control signal supplied to the gate driver 114 or the source driver 115. The control signal means, for example, a clock signal CK or the like that determines the selection period of a scan line.

In the example of FIGS. 4A and 4B, the maximum value Dmax is calculated by the arithmetic circuit 112; alternatively, the maximum value Dmax may be calculated by a program for controlling the electronic device 100 via the processor 101.

Figure 5:
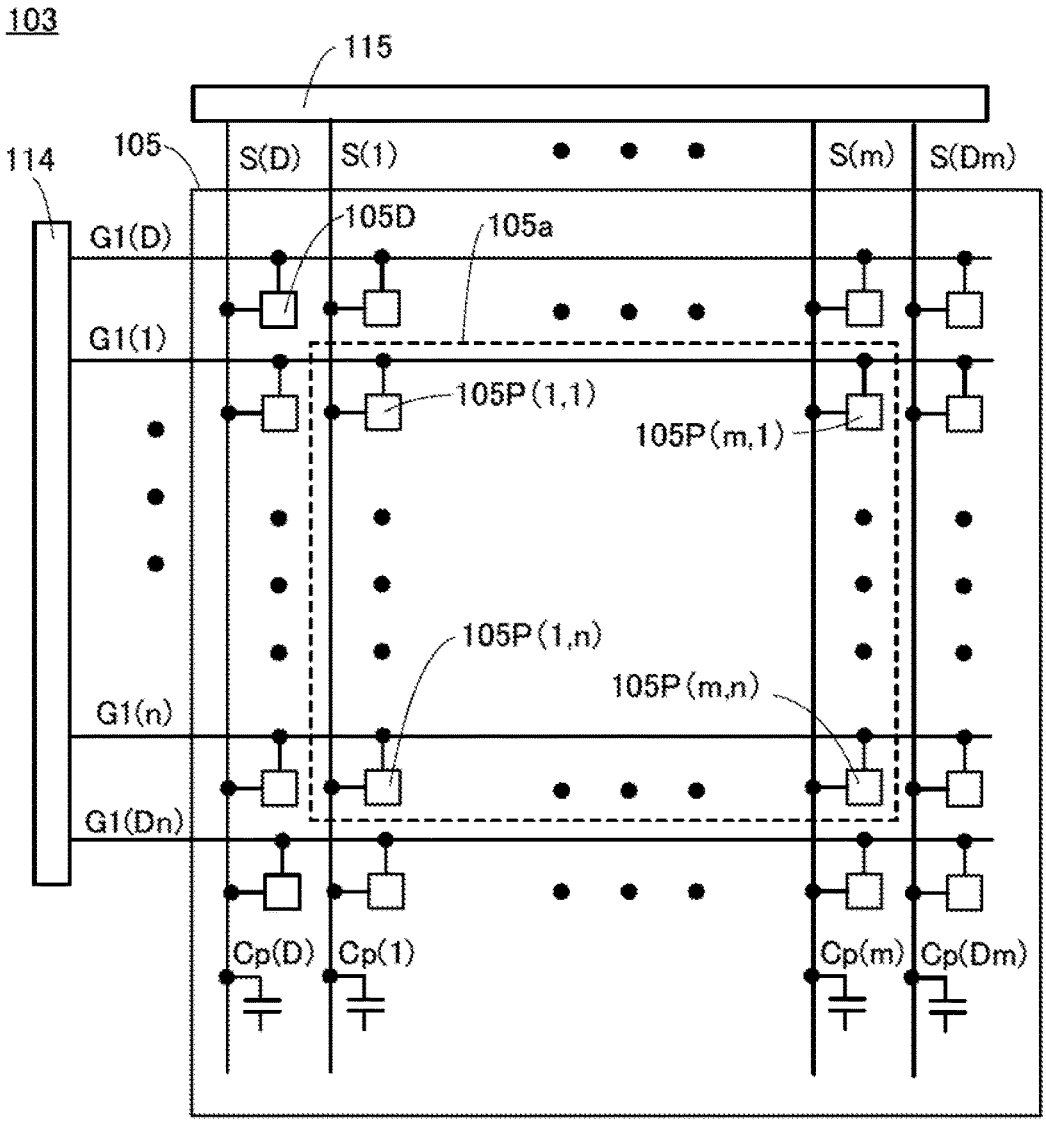
FIG. 5 illustrates a configuration of a display device.

FIG. 5 illustrates a configuration of the display device 103. Unlike the display device 103 in FIGS. 2A and 2B, the display device 103 exemplified in FIG. 5 includes one gate driver 114, one source driver 115, and the display panel 105 for simplification of explanation. The display panel 105 includes a display region 105*a*.

The display region 105*a* includes scan lines G1(1) to G1(*n*), signal lines S(1) to S(m), and pixels 105P(1,1) to 105P(m,n). The gate driver 114 is electrically connected to the scan lines G1(1) to G1(*n*). The source driver 115 is electrically connected to the signal lines S(1) to S(m). The signal lines each include the parasitic capacitance Cp.

In a region other than the display region 105*a*, a dummy pixel 105D, which does not have a display function, is preferably provided. The dummy pixel 105D is electrically connected to a scan line G1(D), a scan line G1(Dn), a signal line S(D) and a signal line S(Dn). The dummy pixel 105D is preferably arranged on the outer edge of the display region so as to surround the display region. The dummy pixel 105D may include a plurality of stages.

Owing to the dummy pixel 105D, the influence of electric field from an adjacent pixel is the same in a display element included in a pixel at an end of the display region 105*a* and in a display element included in a pixel at an inner side of the display region 105*a*. Thus, light leakage through the pixel at the end of the display region 105*a* can be reduced, preventing degradation of display quality. In addition, the dummy pixel 105D may have a function of a protective circuit. The area of the protective circuit is preferably smaller than or equal to that of the dummy pixel 105D.

In the case where the display element in the pixel is a light-transmitting element, light transmission may be blocked by providing a light-blocking film in a position that overlaps with an opening in the dummy pixel 105D. Alternatively, a fixed potential may be applied to the signal lines S(D) and S(Dn), so that a black image is displayed.

In particular, a display device including 4K, 8K, 16K, or more pixels is prone to have a smaller pixel area and to be strongly influenced by the electric field from an adjacent pixel through parasitic capacitance. Hence, the dummy pixel 105D has an effect of reducing quality degradation attributed to light leakage between adjacent pixels. Furthermore, an increased number of pixels increases the parasitic capacitance Cp, thereby easily generating ESD due to charge in a fabrication process. With the dummy pixel 105D, the influence of ESD can be reduced to improve the yield.

Figure 6:
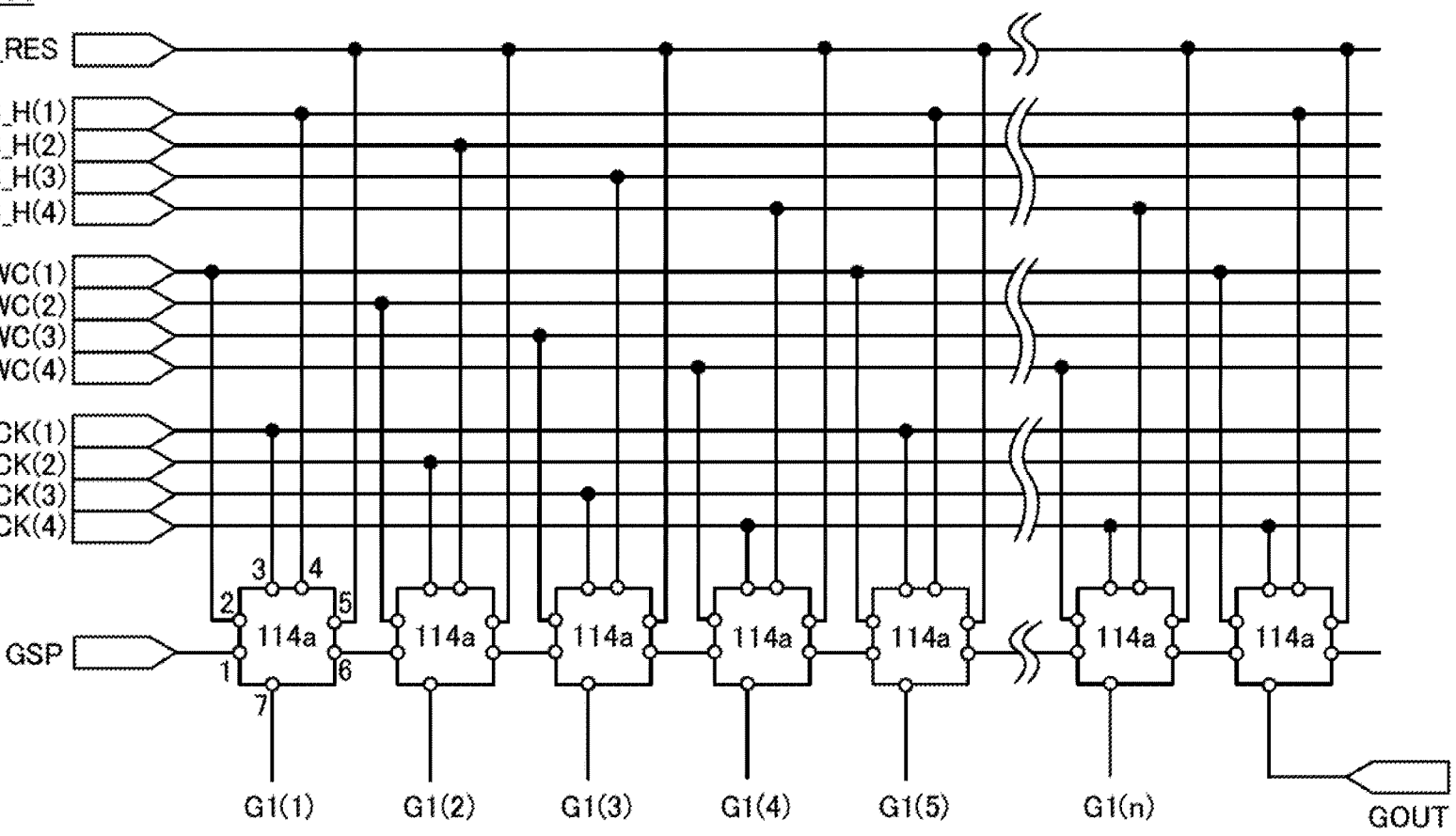
FIG. 6 illustrates a configuration of a gate driver.

FIG. 6 illustrates a configuration of the gate driver 114 that drives the display region 105*a*. The gate driver 114 includes n driver circuits 114*a*. The gate driver 114 has input signals such as a start signal GSP, a clock signal CK, a clock width formation signal PWC, a reset signal RES_H, and a system reset signal INI_RES. An out signal GOUT can monitor whether the gate driver 114 operates.

In the example of FIG. 6, a four-phase input signal is used for driving; however, the input signal for driving is not limited to the four-phase signal and may be, for example, an eight- or more-phase signal.

Figure 7:
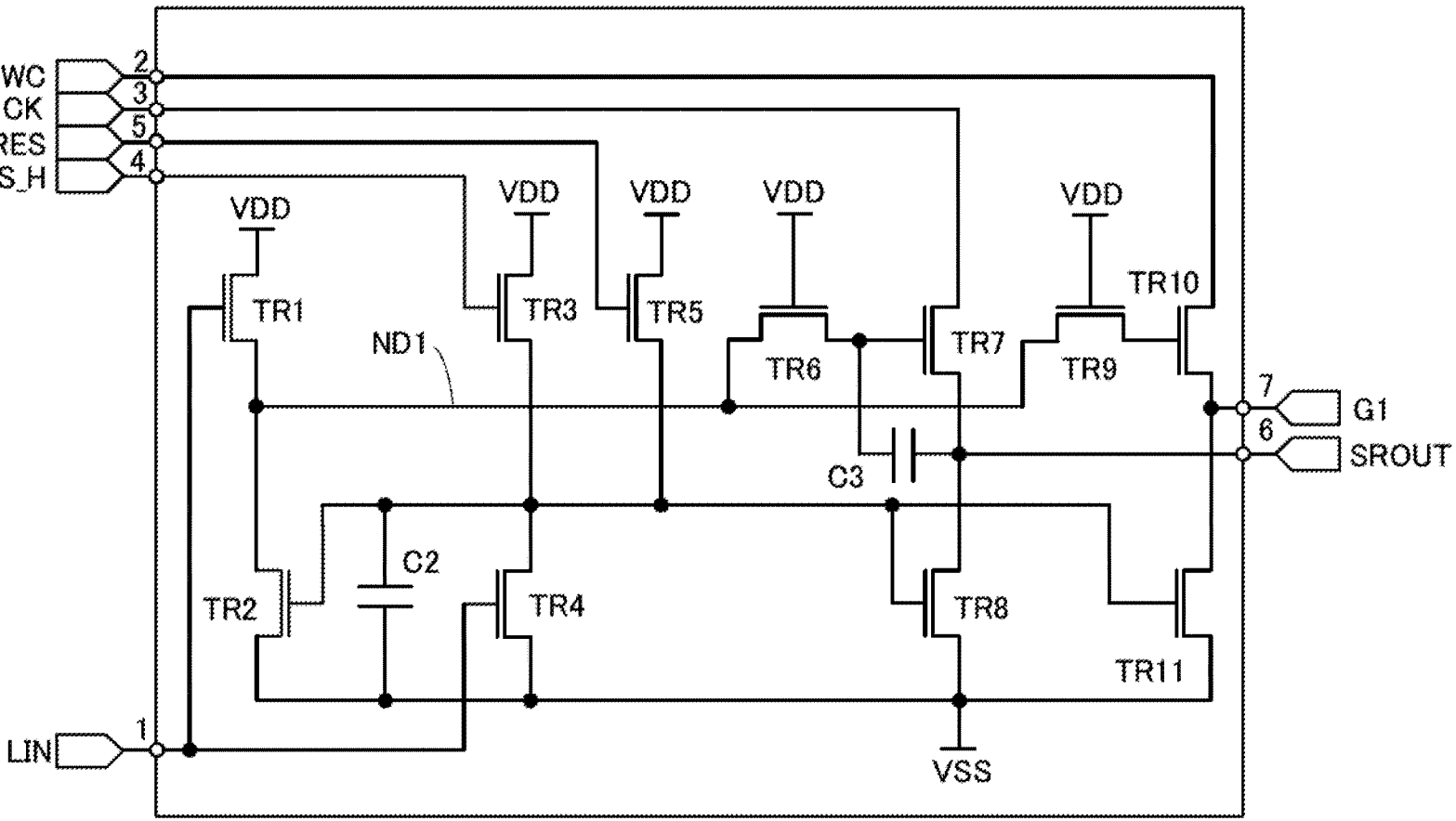
FIG. 7 illustrates a configuration of a gate driver.

FIG. 7 illustrates a configuration of the driver circuit 114*a*. The driver circuit 114*a* includes transistors TR1 to TR11, a capacitor C2, and a capacitor C3. The driver circuit 114*a* also includes terminals 1 to 7.

The start signal GSP or an input signal LIN (an output signal SROUT of the previous stage) is supplied to the terminal 1. The clock width formation signal PWC is supplied to the terminal 2. The clock signal CK is supplied to the terminal 3. The reset signal RES_H is supplied to the terminal 4. The system reset signal INI_RES is supplied to the terminal 5. The terminal 6 outputs the output signal SROUT. The terminal 7 outputs a scan signal.

A high-potential scan signal is supplied to a wiring VDD whereas a low-potential scan signal is supplied to a wiring VSS. Hereinafter, a high-potential signal and a low-potential signal are sometimes referred to as High and Low, respectively, for simplification of explanation.

The terminal 1 is electrically connected to a gate of the transistor TR1 and a gate of the transistor TR4. One of a source and a drain of the transistor TR1 is electrically connected to the wiring VDD. The other of the source and the drain of the transistor TR1 is electrically connected to a node ND1 and one of a source and a drain of the transistor TR2. The other of the source and the drain of the transistor TR2 is electrically connected to the wiring VSS.

A gate of the transistor TR2 is electrically connected to one electrode of the capacitor C2. The other electrode of the capacitor C2 is electrically connected to the wiring VSS. One of a source and a drain of the transistor TR4 is electrically connected to the one electrode of the capacitor C2. The other of the source and the drain of the transistor TR4 is electrically connected to the wiring VSS.

The terminal 4 is electrically connected to a gate of the transistor TR3. One of a source and a drain of the transistor TR3 is electrically connected to the wiring VDD. The other of the source and the drain of the transistor TR3 is electrically connected to the one electrode of the capacitor C2.

The terminal 5 is electrically connected to a gate of the transistor TR5. One of a source and a drain of the transistor TR5 is electrically connected to the wiring VDD. The other of the source and the drain of the transistor TR5 is electrically connected to the one electrode of the capacitor C2.

The terminal 3 is electrically connected to one of a source and a drain of the transistor TR7. The other of the source and the drain of the transistor TR7 is electrically connected to the terminal 6. A gate of the transistor TR7 is electrically connected to one of a source and a drain of the transistor TR6 and one electrode of the capacitor C3. The other electrode of the capacitor C3 is electrically connected to the terminal 6.

The other of the source and the drain of the transistor TR6 is electrically connected to the node ND1. A gate of the transistor TR6 is electrically connected to the wiring VDD. One of a source and a drain of the transistor TR8 is electrically connected to the terminal 6. The other of the source and the drain of the transistor TR8 is electrically connected to the wiring VSS. A gate of the transistor TR8 is electrically connected to the one electrode of the capacitor C2.

The terminal 2 is electrically connected to one of a source and a drain of the transistor TR10. The other of the source and the drain of the transistor TR10 is electrically connected to the terminal 7. A gate of the transistor TR10 is electrically connected to one of a source and a drain of the transistor TR9. The other of the source and the drain of the transistor TR9 is electrically connected to the node ND1. A gate of the transistor TR9 is electrically connected to the wiring VDD.

One of a source and a drain of the transistor TR11 is electrically connected to the terminal 7. The other of the source and the drain of the transistor TR11 is electrically connected to the wiring VSS. A gate of the transistor TR11 is electrically connected to the one electrode of the capacitor C2.

The operation of the driver circuit 114*a* is described. When High is supplied to the input signal LIN, the transistor TR1 is turned on. When the transistor TR1 is turned on, the transistor TR7 can be turned on through the transistor TR6. Furthermore, when the transistor TR1 is turned on, the transistor TR10 can be turned on through the transistor TR9. When the transistor TR7 is turned on, High is supplied to the clock signal CK, so that the output signal SROUT becomes High through the transistor TR7.

When the transistor TR10 is turned on, High is supplied to the clock width formation signal PWC, so that the scan line G1 becomes High. The clock signal CK and the clock width formation signal PWC are preferably High during the same period. Alternatively, the clock width formation signal PWC preferably rises after the clock signal CK and falls before the clock signal CK.

When High is supplied to the reset signal RES_H, the transistor TR3 is turned on. Hence, a High potential is supplied to the capacitor C2 through the transistor TR3. Then, the transistor TR8 and the transistor TR11 are turned on, so that the scan line G1 and the output signal SROUT become Low. Furthermore, since the transistor TR2 is turned on, the node ND1 becomes Low and the transistor TR7 is turned off through the transistor TR6. In addition, the node ND1 becomes Low and the transistor TR10 is turned off through the transistor TR9.

Thus, when High is supplied to the input signal LIN and the clock signal CK and the clock width formation signal PWC are High, the driver circuit 114*a* outputs High to the scan line G1 and the driver circuit 114*a* of the subsequent stage. The selection period of the scan line G1 starts when the input signal LIN and the clock signal CK become High and terminates when the reset signal RES_H becomes High. When the selection period terminates, the clock signal CK is preferably made Low. When the clock signal CK and the reset signal RES_H are High, both the transistor TR7 and the transistor TR8 are turned on and a shoot-through current flows.

By utilizing the above operation, successive scan lines can be selected at a time. For example, High is supplied to the clock signals CK(1) to CK(3), which are connected to the driver circuits 114*a*(n−2) to 114*a*(n) connected in succession. The driver circuits 114*a*(n−2) to 114*a*(n) concurrently output High to the scan lines (n−2) to (n), thereby selecting the plurality of scan lines at a time. After that, the reset signals RES_H(1) to RES_H(3) are concurrently supplied to the driver circuits 114*a*(n−2) to 114*a*(n); thus, the outputs of the scan lines can become Low at a time through the driver circuits 114*a*(n−2) to 114*a*(n). That is, when display is updated with use of the same display data for successive scan lines, a plurality of rows can be updated at a time.

Figure 8:
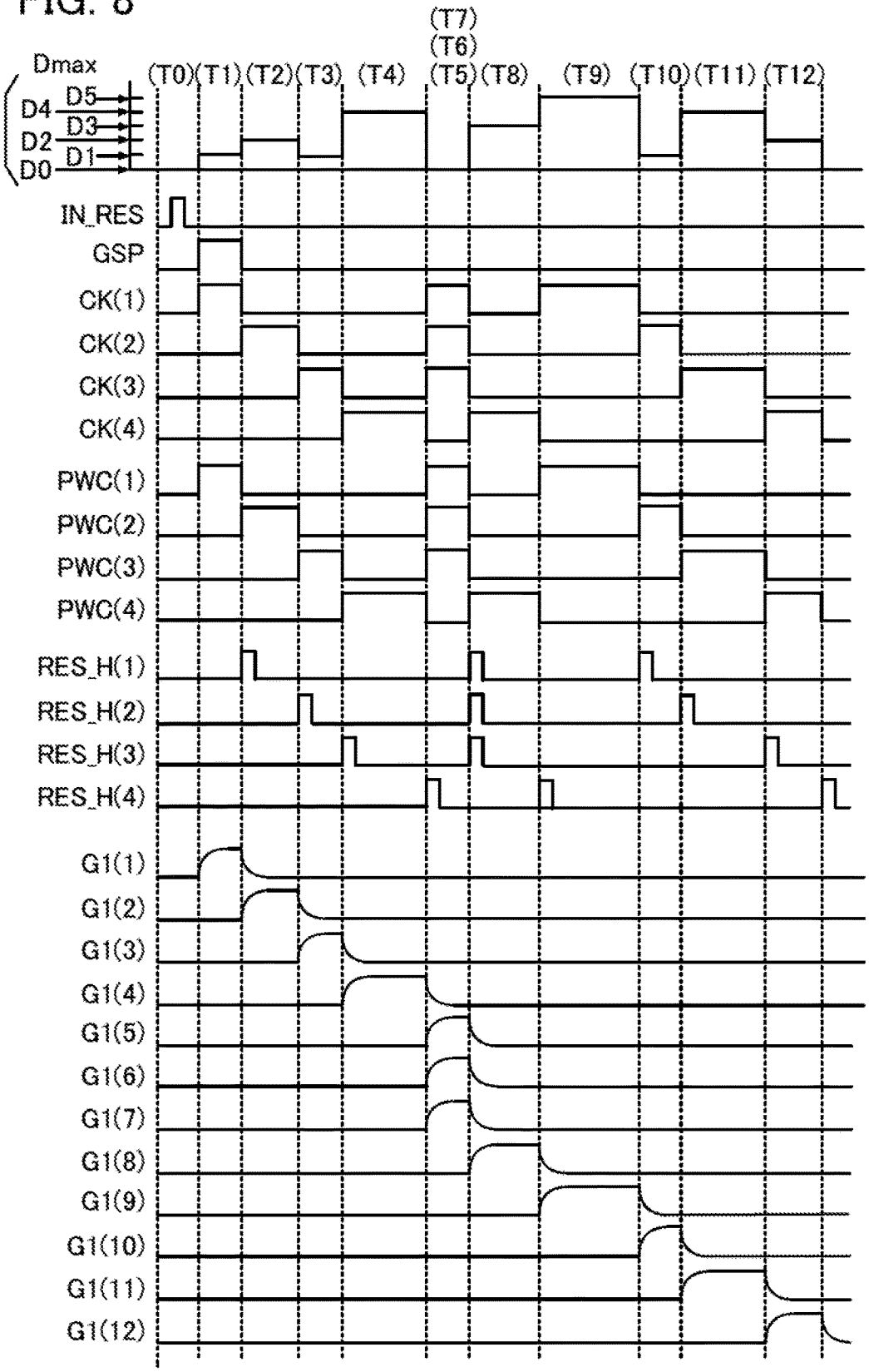
FIG. 8 is a timing chart for a display device.

FIG. 8 is a timing chart showing the operation of the gate driver 114. As an example, in the timing chart of FIG. 8, the maximum value Dmax, which is a difference value of display data calculated by the timing control circuit 113, is divided into six categories as described with reference to FIGS. 4A and 4B. The maximum value of each category is explicitly referred to as Dmax. A selection period of a scan line is determined for each category. The selection period of the scan line is generated by the driver circuit 114*a* in FIG. 7.

FIG. 8 shows a timing chart when the gate driver 114 drives scan lines G1(1) to G1(12). Selection periods of the scan lines G1(1) to G1(12) are represented by periods (T0) to (T12).

In the period (T0), the display device 103 is reset and the gate driver 114 is initialized. When the system reset signal INI_RES becomes High, all the outputs of the driver circuits 114*a* become Low. Thus, all the scan lines become Low.

In the period (T1), the start signal GSP is supplied to the driver circuit 114*a*(1). Preferably, the clock signal CK(1) and the clock width formation signal PWC(1) are High during the period in which the start signal GSP is High. During the period in which the clock signal CK(1) is High, a selection period of a scan line corresponding to the category D1 is selected. This indicates that the gray level of the maximum value Dmax falls in the range of 1 to 50. The selection period of the scan line G1(1) set in the category D1 is long enough for the synthetic capacitance Csy of the capacitor P2 and the parasitic capacitance Cp to be charged and discharged.

In the period (T2), High is supplied to the terminal 1 of the driver circuit 114*a*(2) from the output signal SROUT of the driver circuit 114*a*(1). Then, the reset signal RES_H(1) is supplied, so that the output signal SROUT of the driver circuit 114*a*(1) changes to Low. During the period in which the clock signal CK(2) and the clock width formation signal PWC(2) are High, a selection period of a scan line corresponding to the category D2 is selected. This indicates that the gray level of the maximum value Dmax falls in the range of 51 to 100. Thus, the scan line G1(2) is High in the selection period set in the category D2.

In the period (T3), High is supplied to the terminal 1 of the driver circuit 114*a*(3) from the output signal SROUT of the driver circuit 114*a*(2). Then, the reset signal RES_H(2) is supplied, so that the output signal SROUT of the driver circuit 114*a*(2) changes to Low. During the period in which the clock signal CK(3) and the clock width formation signal PWC(3) are High, a selection period of a scan line corresponding to the category D1 is selected. This indicates that the gray level of the maximum value Dmax falls in the range of 1 to 50. Thus, the scan line G1(3) is High in the selection period set in the category D1.

In the period (T4), High is supplied to the terminal 1 of the driver circuit 114*a*(4) from the output signal SROUT of the driver circuit 114*a*(3). Then, the reset signal RES_H(3) is supplied, so that the output signal SROUT of the driver circuit 114*a*(3) changes to Low. During the period in which the clock signal CK(4) and the clock width formation signal PWC(4) are High, a selection period of a scan line corresponding to the category D4 is selected. This indicates that the gray level of the maximum value Dmax falls in the range of 151 to 200. Thus, the scan line G1(4) is High in the selection period set in the category D4. The display data has a large difference value; thus, the selection period of the scan line can be lengthened so that the synthetic capacitance Csy can be charged and discharged.

The periods (T5) to (T7) each correspond to the category D0, namely, the display data does not change. Accordingly, the scan lines G1(5) to G1(7) are selected at a time and updated with the same display data. Note that the selection period of the scan line corresponding to the category D0 can be appropriately determined; in the timing chart of FIG. 8, for example, the selection period for the category D0 is the same as that for the category D1.

High is supplied to the terminal 1 of the driver circuit 114*a*(5) from the output signal SROUT of the driver circuit 114*a*(4). At this time, the clock signals CK(1) to CK(3) and the clock width formation signals PWC(1) to PWC(3) are changed to High at a time. Accordingly, High is supplied to the terminal 1 of the driver circuit 114*a*(6) from the output signal SROUT of the driver circuit 114*a*(5). Then, High is supplied to the terminal 1 of the driver circuit 114*a*(7) from the output signal SROUT of the driver circuit 114*a*(6). Thus, the scan lines G1(5) to G1(7) corresponding to the category D1 become High at a time. This enables the display data of the scan lines G1(5) to G1(7) to be concurrently updated.

In the period (T8), High is supplied to the terminal 1 of the driver circuit 114*a*(8) from the output signal SROUT of the driver circuit 114*a*(7). Then, the reset signals RES_H(1) to RES_H(3) are supplied, so that the output signals SROUT of the driver circuits 114*a*(5) to 114*a*(7) change to Low. During the period in which the clock signal CK(4) and the clock width formation signal PWC(4) are High, a selection period of a scan line corresponding to the category D3 is selected. This indicates that the gray level of the maximum value Dmax falls in the range of 101 to 150. Thus, the scan line G1(8) is High in the selection period set in the category D3. The display data has a large difference value; thus, the scan line can be selected for a long period so that the synthetic capacitance Csy can be charged and discharged.

The operation in the periods (T9) to (T12) is similar to the above, and therefore, is not repeatedly described.

In a display device including 4K (3840×2160), 8K (7680×4320), 16K, or more pixels, each pixel circuit has a small area, requiring a large number of scan lines and signal lines. Accordingly, the number of intersection points of the scan line and the signal line increases, so that the parasitic capacitance Cp of the signal line tends to increase. In the method shown in this embodiment, a potential charged in the parasitic capacitance Cp is utilized as a precharge potential, allowing optimization of the writing period of data necessary for display updating. The surplus period, which is produced by optimizing the writing period of the display data, can be utilized for idling stop driving using power gating or clock gating. The surplus period can also be used as a sensing period of a touch sensor, improving the sensing accuracy thereof.

Figure 9:
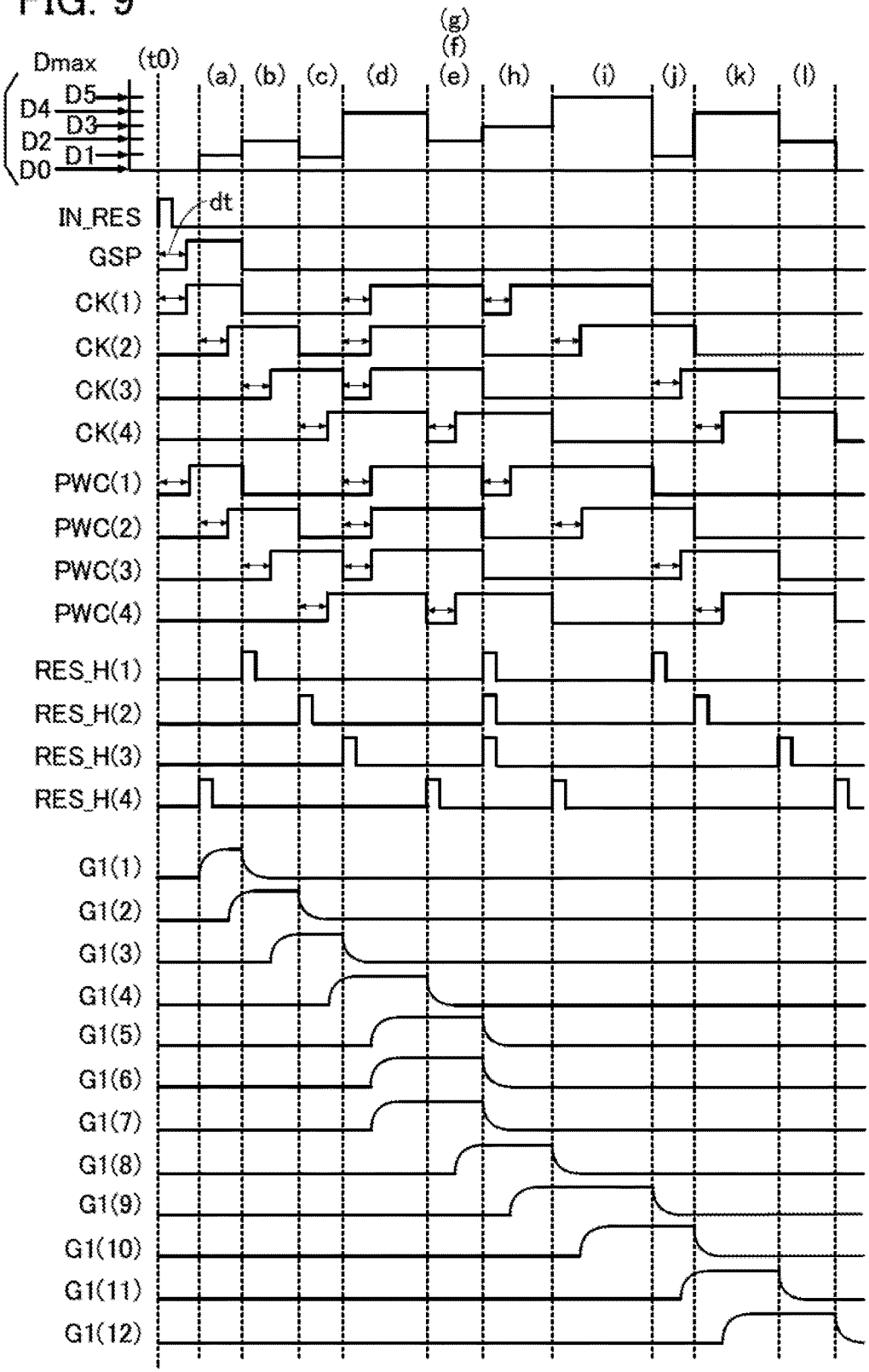
FIG. 9 is a timing chart for a display device.

FIG. 9 is a timing chart different from that of FIG. 8. FIG. 9 shows a method of utilizing the parasitic capacitance Cp more actively than that in FIG. 9. In FIG. 9 as well as in FIG. 8, the selection period of the scan line G1(*n*) is set during a period in which the clock signal CK input to the driver circuit 114*a*(n) for driving the scan line G1(*n*) is High. Here, description is made on the assumption that the clock signal CK(3) is input to the driver circuit 114*a*(n).

The timing chart of FIG. 9 is different from that of FIG. 8 in that the clock signal CK(3) is input to the driver circuit 114*a*(n) when the scan line G1(*n*−1) is selected by the previous driver circuit 114*a*(n−1). Note that preferably, the clock signal CK(3) rises later than the clock signal CK(2) input to the previous driver circuit 114*a*(n−1) by a delay time dt.

When the scan line G1(*n*−1) and the subsequent scan line G1(*n*) are selected at a time, the same display data is written to the pixel 105P(m,n−1) and the pixel 105P(m,n) which are connected to the m-th signal line. Then, the scan line G1(*n*−1) is deselected, so that the display data of the pixel 105P(m,n−1) is determined. After that, the display data supplied to the m-th signal line changes to the display data of the pixel 105P(m,n); at that time, the selection transistor P1 in the pixel 105P(m,n) is already on. That is, the switching period necessary for the selection transistor P1 to be turned on can be reduced.

Hence, the switching period of the selection transistor P1 can be reduced regardless of the mobility of the selection transistor P1, which is effective in ensuring the writing period of data to the pixel in a display device including 4K, 8K, 16K, or more pixels.

Note that in this embodiment, one embodiment of the present invention has been described. Other embodiments of the present invention are described in the other embodiments. Note that one embodiment of the present invention is not limited to the above examples. In other words, various embodiments of the invention are described in this embodiment and the other embodiments, and one embodiment of the present invention is not limited to a particular embodiment. The example in which one embodiment of the present invention is applied to a display device is described; however, one embodiment of the present invention is not limited thereto. Depending on circumstances or conditions, one embodiment of the present invention is not necessarily applied to a display device. One embodiment of the present invention may be applied to a semiconductor device with another function, for example. Although an example in which a channel formation region, a source region, a drain region, or the like of a transistor includes an oxide semiconductor is described as one embodiment of the present invention, one embodiment of the present invention is not limited thereto. Depending on the circumstances or conditions, a variety of semiconductors may be used for a variety of transistors in one embodiment of the present invention, the channel formation regions of the transistors, the source and drain regions of the transistors, and the like. Depending on the circumstances or conditions, a variety of transistors in one embodiment of the present invention, the channel formation regions of the transistors, the source and drain regions of the transistors, and the like may include, for example, at least one of silicon, germanium, silicon germanium, silicon carbide, gallium arsenide, aluminum gallium arsenide, indium phosphide, gallium nitride, and an organic semiconductor. Depending on the circumstances or conditions, transistors in one embodiment of the present invention, the channel formation regions of the transistors, the source and drain regions of the transistors, and the like do not necessarily include an oxide semiconductor.

The structure and method described in this embodiment can be used in appropriate combination with any of the other structures and methods described in the other embodiments.

Embodiment 2

In this embodiment, a display device of one embodiment of the present invention will be described.

One embodiment of the present invention is a display device including a display region (also referred to as a pixel portion) where a plurality of pixels are arranged in a matrix. In the pixel portion, a plurality of wirings to which a selection signal is supplied (also referred to as gate lines or scan lines) and a plurality of wirings to which a signal written to a pixel (also referred to as a video signal or the like) is supplied (also referred to as source lines, signal lines, data lines, or the like) are provided. The gate lines are provided parallel to one another and the source lines are provided parallel to one another. The gate lines and the source lines intersect with each other.

One pixel includes at least one transistor and one display element. The display element includes a conductive layer that functions as a pixel electrode. The conductive layer is electrically connected to one of a source and a drain of the transistor. A gate of the transistor is electrically connected to a gate line. The other of the source and the drain is electrically connected to a source line.

Here, a direction in which the gate lines extend is called a row direction or a first direction, and a direction in which the source lines extend is called a column direction or a second direction.

Here, the same selection signal is preferably supplied to two or more adjacent gate lines. That is, selection periods of these gate lines are preferably the same. In the following description, three gate lines are regarded as a group. Note that the number of gate lines that are selected at the same time is not limited to three, and four or more gate lines may be regarded as a group.

In the case where the same selection signal is supplied to three gate lines, three pixels which are adjacent to each other in the column direction are concurrently selected. Thus, different source lines are connected to the three pixels. That is, three source lines are arranged for each column.

Here, the middle source line among the three source lines is preferably positioned to overlap with the conductive layer that functions as a pixel electrode. This can reduce the distance between pixel electrodes.

Furthermore, part of a semiconductor layer of a transistor is preferably positioned between the outer source line and the middle source line among the three source lines. For example, in the case where first to third source lines are arranged in this order, part of a semiconductor layer of a transistor connected to the first source line and part of a semiconductor layer of a transistor connected to the second source line are positioned between the first source line and the second source line. Furthermore, part of a semiconductor layer of a transistor connected to the third source line is positioned between the second source line and the third source line. Thus, a node between each source line and each semiconductor layer can be prevented from intersecting with another source line. Accordingly, the parasitic capacitance between the source lines can be reduced.

With such a configuration, one horizontal period can be longer than the conventional one. For example, in the case where three gate lines are supplied with the same selection signal, the length of one horizontal period can be three times the length of the conventional one. Furthermore, since the parasitic capacitance between the source lines can be reduced, the load of the source lines can be reduced. Thus, even a significantly high-resolution display device such as a 4K display or an 8K display can be operated with use of a transistor with a low field-effect mobility. The above-described configurations can be applied to a large display device with a diagonal screen size of 50 inches or larger, 60 inches or larger, or 70 inches or larger.

A more specific example of the display device will be described below with reference to drawings.

[Structure Example of Display Device]

Figure 10:
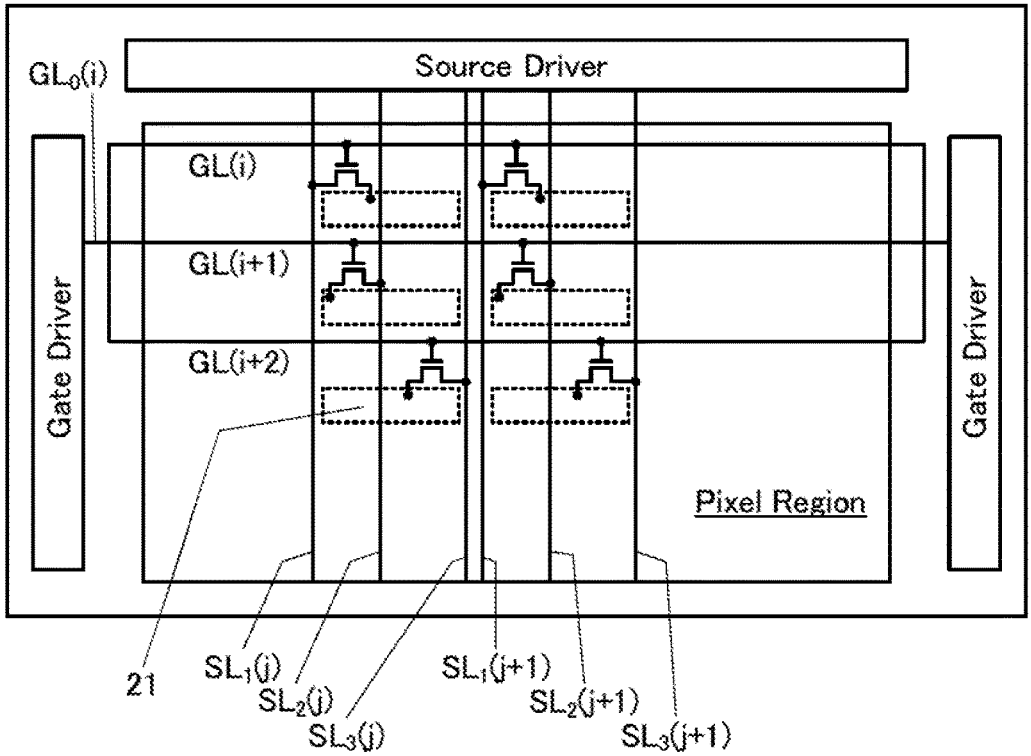
FIG. 10 illustrates a configuration of a display device.

FIG. 10 is a block diagram of the display device 103 of one embodiment of the present invention. The display device 103 includes a pixel region (a display region), a source driver, and a gate driver.

FIG. 10 shows an example in which two gate drivers are provided with a pixel region positioned therebetween. A plurality of gate lines $GL_0$ are connected to the two gate drivers. In FIG. 10, an i-th gate line $GL_0(i)$ is illustrated. The gate line $GL_0(i)$ is electrically connected to three gate lines (a gate line GL(i), a gate line GL(i+1), and a gate line GL(i+2)). Accordingly, the three gate lines are supplied with the same selection signal.

A plurality of source lines are connected to the source driver. Three source lines are provided for one pixel column. FIG. 10 illustrates three source lines (a source line $SL_1(j)$, a source line $SL_2(j)$, and a source line $SL_3(j)$) for the j-th pixel column and three source lines (a source line $SL_1(j+1)$, a source line $SL_2(j+1)$, and a source line $SL_3(j+1)$) for the (j+1)-th pixel column.

One pixel includes at least one transistor and one conductive layer 21 that functions as a pixel electrode of a display element. Each pixel corresponds to one color. In the case where color display is performed by utilizing mixture of light emitted from a plurality of pixels, the pixel can be called a sub-pixel.

Furthermore, a plurality of pixels arranged in the column direction preferably emit light of the same color. In the case where a liquid crystal element is used as a display element, coloring layers that transmit light of the same color are provided to overlap with liquid crystal elements in the pixels arranged in the column direction.

Here, it is preferable that part of the inner source line (the source line $SL_2(j)$) among three source lines for one pixel column overlap with the conductive layer 21. Moreover, it is preferable that the source line $SL_2(j)$ be arranged at the center portion of the conductive layer 21 so as to be apart from the other source lines. For example, the distance between the source line $SL_1(j)$ and the source line $SL_2(j)$ is preferably about equal to the distance between the source line $SL_2(j)$ and the source line $SL_3(j)$. As a result, the parasitic capacitance between the source lines can be reduced more effectively and the load of each source line can be reduced.

As a method for achieving high resolution with use of a transistor including amorphous silicon or the like, which has difficulty in having a high field-effect mobility, there is a method in which a display region of a display device is divided into a plurality of pixel regions and driven. In the above method, a boundary portion between divided pixel regions might be visually recognized owing to variations in characteristics of a driver circuit, which decreases the visibility in some cases. In addition, image processing or the like for dividing in advance image data to be input is necessary; thus, a large-scale image processing device that can operate at a high speed is required.

In contrast, the display device of one embodiment of the present invention can be driven without dividing the display region even when including a transistor with a relatively low field-effect mobility.

Although FIG. 10 shows an example in which a source driver is arranged along a side of a pixel region, source drivers may be arranged along facing two sides of the pixel region such that the pixel region is sandwiched between the source drivers.

Figure 11:
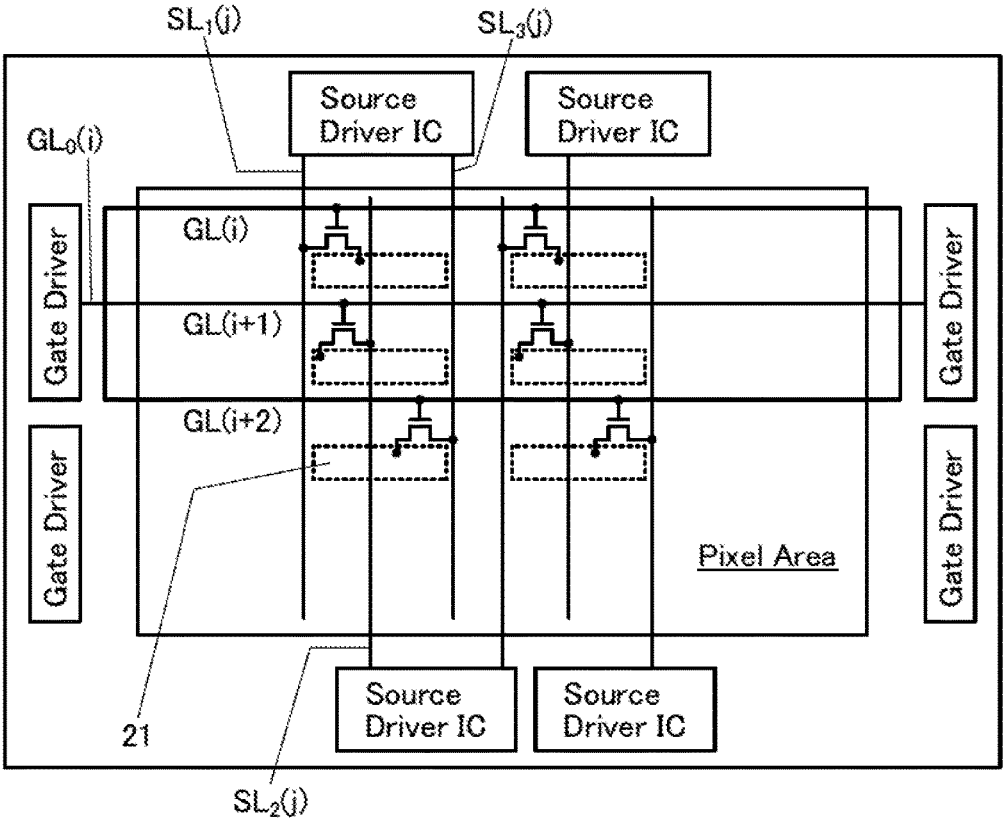
FIG. 11 illustrates a configuration of a display device.

In the example shown in FIG. 11, a source driver IC connected to odd-numbered source lines among a plurality of source lines provided in a pixel region and a source driver IC connected to even-numbered source lines are positioned to face each other. That is, the plurality of source lines arranged in the row direction are alternately connected to different source driver ICs. FIG. 11 shows the example in which the source line $SL_1(j)$ and the source line $SL_3(j)$ are connected to the source driver IC on the upper side, and the source line $SL_2(j)$ is connected to the source driver IC on the lower side. With such a structure, display unevenness due to a potential drop caused by wiring resistance can be suppressed even in a large display device. In the structure of FIG. 11, the area where the source driver IC is positioned can be larger than that in the structure of FIG. 10. Thus, the distance between two adjacent source driver ICs can be large, improving the manufacturing yield.

[Pixel Structure Example]

An example of the structure of a pixel arranged in a pixel region of the display device 103 will be described below.

Figure 12A:
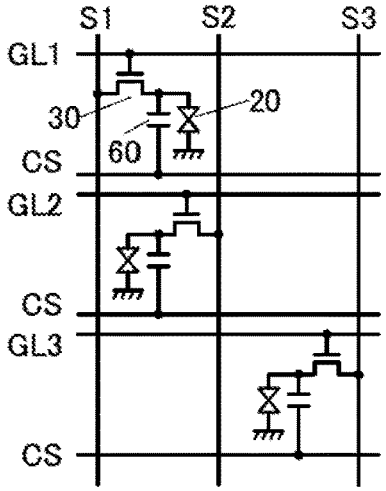
FIGS. 12A to 12D each illustrate a configuration of a display device.

FIG. 12A is a circuit diagram including three pixels arranged in the column direction.

Each pixel includes a transistor 30, a liquid crystal element 20, and a capacitor 60.

Wirings S1 to S3 correspond to source lines, and wirings GL1 to GL3 correspond to gate lines. A wiring CS is electrically connected to one electrode of the capacitor 60, and a predetermined potential is applied to the wiring CS.

A pixel is electrically connected to any one of the wirings S1 to S3 and any one of the wirings GL1 to GL3. As an example, a pixel connected to the wiring S1 and the wiring GL1 is described. A gate of the transistor 30 is electrically connected to the wiring GL1, one of a source and a drain thereof is electrically connected to the wiring S1, and the other of the source and the drain thereof is electrically connected to the other electrode of the capacitor 60 and one electrode (pixel electrode) of the liquid crystal element 20. A common potential is supplied to the one electrode of the capacitor 60.

Figure 12B:
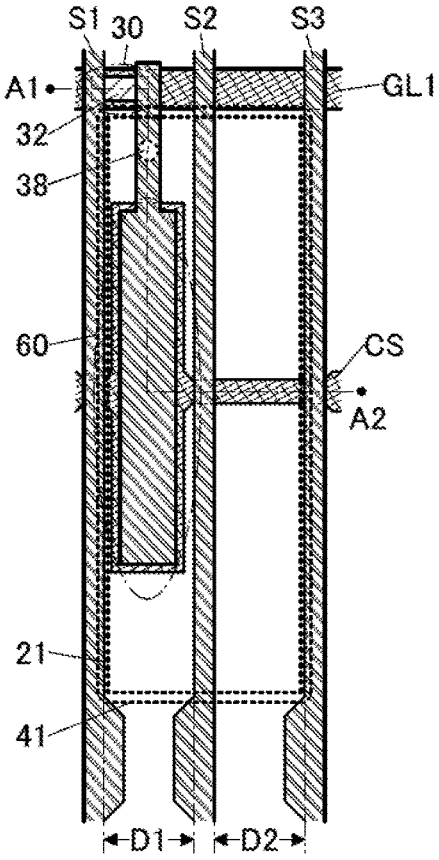

FIG. 12B illustrates an example of a layout of the pixel connected to the wiring S1 and the wiring GL1.

As illustrated in FIG. 12B, the wiring GL1 and the wiring CS extend in the row direction (the lateral direction), and the wirings S1 to S3 extend in the column direction (the longitudinal direction).

In the transistor 30, a semiconductor layer 32 is provided over the wiring GL1, and part of the wiring GL1 functions as a gate electrode. Part of the wiring S1 functions as one of a source electrode and a drain electrode. The semiconductor layer 32 includes a region positioned between the wiring S1 and the wiring S2.

The other of the source electrode and the drain electrode of the transistor 30 is electrically connected to the conductive layer 21 that functions as a pixel electrode through a connection portion 38. A coloring layer 41 is provided in a position overlapping with the conductive layer 21.

The conductive layer 21 includes a portion overlapping with the wiring S2. It is preferable that the conductive layer 21 not overlap with the wiring S1 and the wiring S3 which are positioned along the both sides. Thus, the parasitic capacitance of the wiring S1 and the wiring S3 can be reduced.

When the distance between the wiring S1 and the wiring S2 is called a distance D1 and the distance between the wiring S2 and the wiring S3 is called a distance D2, the distance D1 is preferably about equal to the distance D2. For example, the ratio of the distance D1 to the distance D2 is 0.8 to 1.2, preferably 0.9 to 1.1. This can reduce the parasitic capacitance between the wiring S1 and the wiring S2 and the parasitic capacitance between the wiring S2 and the wiring S3.

Owing to a wide distance between wirings, dust or the like that adheres between the wirings in the manufacturing process is easily removed by washing, improving the yield. When the washing is performed with a line washing apparatus, it is preferable that during the washing, a substrate be moved along the direction in which the wiring S1 and the like extend, in which case dust can be removed more easily.

Furthermore, in FIG. 12B, part of the wirings S1 to S3 and part of the wiring CS each have a portion wider than the other portion. Thus, the wiring resistance can be small.

Figure 12C:
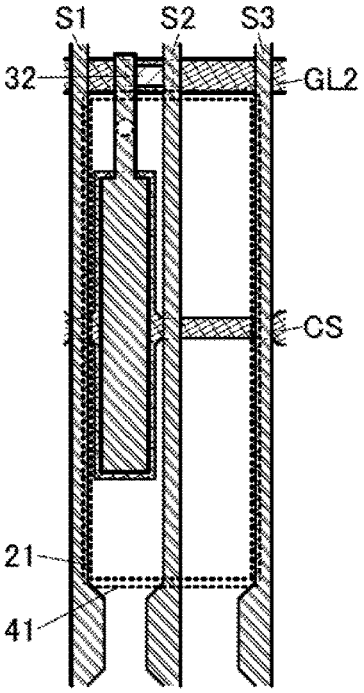
Figure 12D:
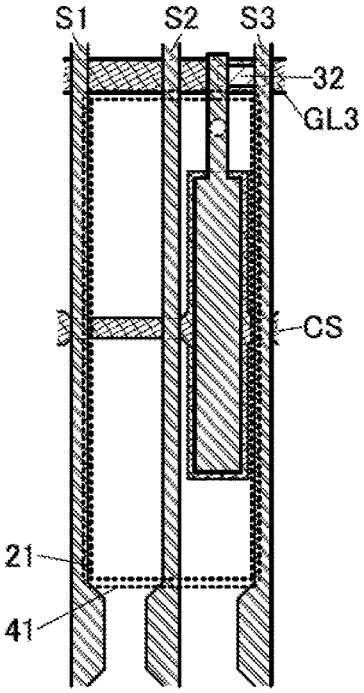

FIGS. 12C and 12D illustrate examples of layouts of the pixel connected to the wiring GL2 and the pixel connected to the wiring GL3, respectively.

In FIG. 12C, the semiconductor layer 32 provided over the wiring GL2 is electrically connected to the wiring S2, and has a region positioned between the wiring S1 and the wiring S2.

In FIG. 12D, the semiconductor layer 32 provided over the wiring GL3 is electrically connected to the wiring S3, and has a region positioned between the wiring S2 and the wiring S3.

The pixels illustrated in FIGS. 12B to 12D preferably emit light of the same color. The coloring layers 41 that transmit light of the same color can be provided in a region overlapping with the conductive layer 21. Pixels that are adjacent in the column direction can have the same structure as those of FIGS. 12B to 12D; however, the coloring layers 41 emit light of different colors.

[Cross-Sectional Structure Example]

An example of the cross-sectional structure of the display device will be described below.

<Cross-Sectional Structure Example 1>

Figure 13:
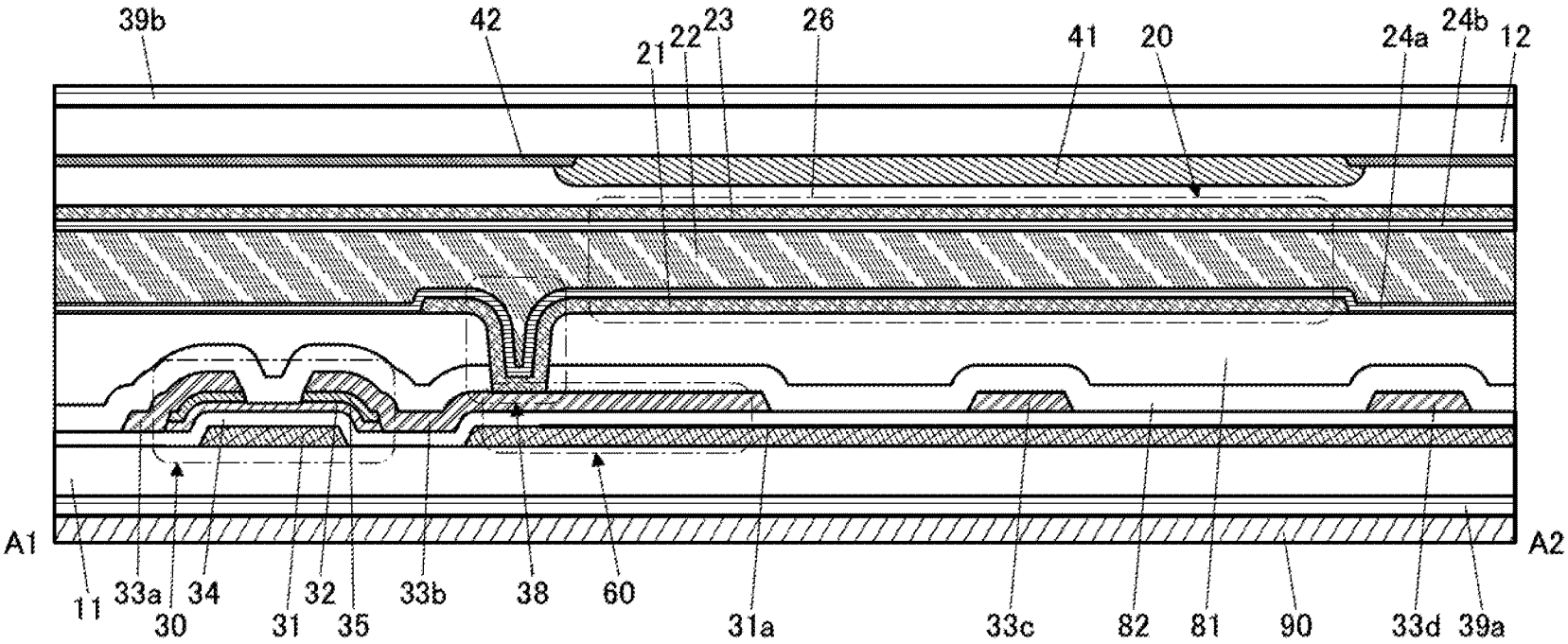
FIG. 13 illustrates a structure of a display device.

FIG. 13 illustrates an example of a cross section along line A1-A2 in FIG. 12B. Here, an example where a transmissive liquid crystal element 20 is used as a display element is shown. In FIG. 13, a substrate 12 side is a display surface side.

In the display device 103, a liquid crystal 22 is provided between a substrate 11 and the substrate 12. The liquid crystal element 20 includes the conductive layer 21 provided on the substrate 11 side, a conductive layer 23 provided on the substrate 12 side, and the liquid crystal 22 provided between the conductive layers 21 and 23. Furthermore, an alignment film 24*a* is provided between the liquid crystal 22 and the conductive layer 21 and an alignment film 24*b* is provided between the liquid crystal 22 and the conductive layer 23.

The conductive layer 21 functions as a pixel electrode. The conductive layer 23 functions as a common electrode or the like. The conductive layer 21 and the conductive layer 23 each have a function of transmitting visible light. Thus, the liquid crystal element 20 is a transmissive liquid crystal element.

The coloring layer 41 and a light-blocking layer 42 are provided on a surface of the substrate 12 that faces the substrate 11. An insulating layer 26 is provided to cover the coloring layer 41 and the light-blocking layer 42, and the conductive layer 23 is provided to cover the insulating layer 26. The coloring layer 41 is provided in a region overlapping with the conductive layer 21. The light-blocking layer 42 is provided to cover the transistor 30 and the connection portion 38.

A polarizing plate 39*a* is located outward from the substrate 11, and a polarizing plate 39*b* is located outward from the substrate 12. Furthermore, a backlight unit 90 is located outward from the polarizing plate 39*a*.

The transistor 30, the capacitor 60, and the like are provided over the substrate 11. The transistor 30 functions as a selection transistor of a pixel. The transistor 30 is electrically connected to the liquid crystal element 20 through the connection portion 38.

The transistor 30 illustrated in FIG. 13 is what is called a channel-etched bottom-gate transistor. The transistor 30 includes a conductive layer 31 functioning as a gate electrode, an insulating layer 34 functioning as a gate insulating layer, the semiconductor layer 32, a pair of impurity semiconductor layers 35 functioning as a source and a drain region, and a pair of conductive layers 33*a* and 33*b* functioning as a source and a drain electrode. A region of the semiconductor layer 32 that overlaps with the conductive layer 31 functions as a channel formation region. The semiconductor layer 32 is in contact with the impurity semiconductor layer 35 and the impurity semiconductor layer 35 is in contact with the conductive layer 33*a* or 33*b*.

Note that the conductive layer 31 corresponds to part of the wiring GL1 in FIG. 12B, and the conductive layer 33*a* corresponds to part of the wiring S1. Furthermore, a conductive layer 31*a*, a conductive layer 33*c*, and a conductive layer 33*d*, which are described later, correspond to the wiring CS, the wiring S2, and the wiring S3, respectively.

A semiconductor containing silicon is preferably used for the semiconductor layer 32. For example, amorphous silicon, microcrystalline silicon, polycrystalline silicon, or the like can be used. Amorphous silicon is particularly preferable because it can be formed over a large substrate with a high yield. A display device of one embodiment of the present invention can perform favorable display even with a transistor including amorphous silicon having a relatively low field-effect mobility. As amorphous silicon, hydrogenated amorphous silicon (denoted by a-Si:H in some cases) in which dangling bonds are terminated by hydrogen is preferably used.

The impurity semiconductor film included in the impurity semiconductor layer 35 is formed using a semiconductor to which an impurity element imparting one conductivity type is added. In the case where the transistor is an n-channel transistor, for example, silicon to which P or As is added is given as a semiconductor to which an impurity element imparting one conductivity type is added. In the case where the transistor is a p-channel transistor, for example, it is possible to add B as the impurity element imparting one conductivity type; however, it is preferable to use an n-channel transistor. Note that the impurity semiconductor layer 35 may be formed using an amorphous semiconductor or a crystalline semiconductor such as a microcrystalline semiconductor.

The capacitor 60 includes the conductive layer 31*a*, the insulating layer 34, and the conductive layer 33*b*. Furthermore, the conductive layer 33*c* and the conductive layer 33*d* are provided over the conductive layer 31*a* with the insulating layer 34 provided therebetween.

An insulating layer 82 and an insulating layer 81 are stacked to cover the transistor 30 and the like. The conductive layer 21 functioning as a pixel electrode is provided over the insulating layer 81. In the connection portion 38, the conductive layer 21 is electrically connected to the conductive layer 33*b* through an opening in the insulating layers 81 and 82. The insulating layer 81 preferably functions as a planarization layer. The insulating layer 82 preferably functions as a protective film that inhibits diffusion of impurities or the like to the transistor 30 and the like. The insulating layer 82 can be formed using an inorganic insulating material, and the insulating layer 81 can be formed using an organic insulating material, for example.

<Cross-Sectional Structure Example 2>

In the above example, a vertical electric field mode liquid crystal element in which a pair of electrodes are provided over and under a liquid crystal is used as the liquid crystal element; however, the structure of the liquid crystal element is not limited thereto and any of a variety of liquid crystal elements can be used.

Figure 14:
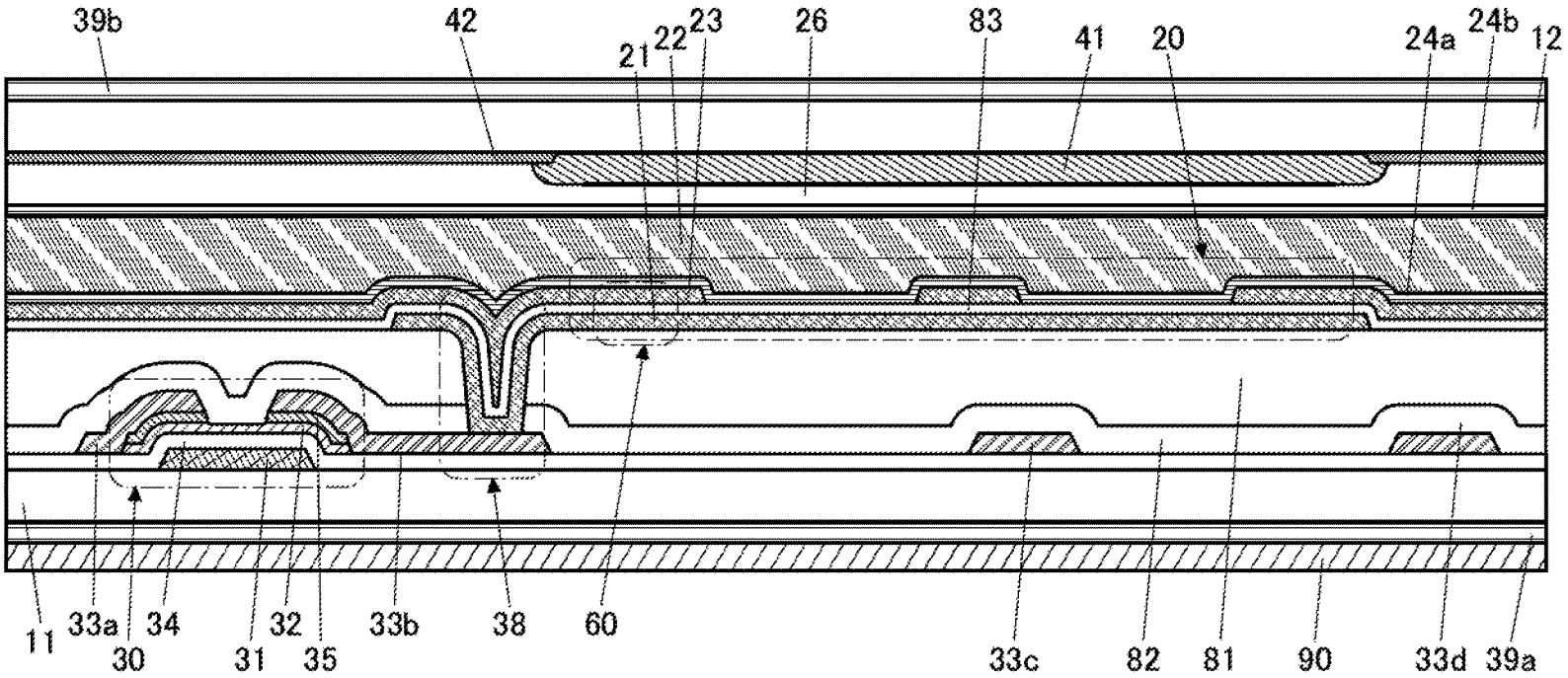
FIG. 14 illustrates a structure of a display device.

FIG. 14 is a schematic cross-sectional view of a display device including a liquid crystal element using a fringe field switching (FFS) mode.

The liquid crystal element 20 includes the conductive layer 21 functioning as a pixel electrode and the conductive layer 23 overlapping with the conductive layer 21 with an insulating layer 83 provided therebetween. The conductive layer 23 has a slit-like or comb-like top surface.

In such a structure, a capacitor, which can be used as the capacitor 60, is formed in a region where the conductive layer 21 and the conductive layer 23 overlap with each other. Thus, the area occupied by a pixel can be reduced, leading to a high-definition display device. In addition, the aperture ratio can be improved.

Here, the smaller the number of photolithography steps in a manufacturing process of a display device is, i.e., the smaller the number of photomasks is, the lower the manufacturing cost can be.

For example, the structure illustrated in FIG. 13 can be manufactured through five photolithography steps, i.e., a formation step of the conductive layer 31 and the like, a formation step of the semiconductor layer 32 and the impurity semiconductor layer 35, a formation step of the conductive layer 33*a* and the like, a formation step of the opening to be the connection portion 38, and a formation step of the conductive layer 21, among the steps on the substrate 11 side. That is, a back plane substrate can be manufactured with five photomasks. On the other hand, on the substrate 12 (counter substrate) side, an ink-jet method, a screen printing method, or the like is preferably used as the formation methods of the coloring layer 41 and the light-blocking layer 42, in which case a photomask is unnecessary. For example, in the case where three-color coloring layers 41 and the light-blocking layer 42 are provided, four photomasks can be reduced compared with the case where these are formed by a photolithography process.

The above is the description of the cross-sectional structure examples.

<Structure of Transistor>

Structure examples of a transistor different from the above will be described below.

Figure 15A:
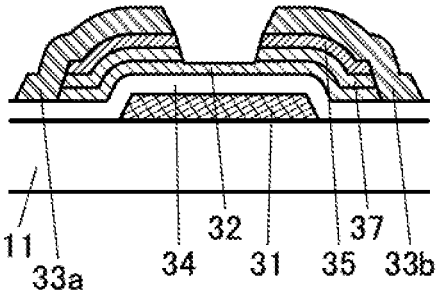
FIGS. 15A to 15F each illustrate a structure of a display device.

A transistor illustrated in FIG. 15A includes a semiconductor layer 37 between the semiconductor layer 32 and the impurity semiconductor layer 35.

The semiconductor layer 37 may be formed using the same semiconductor film as the semiconductor layer 32. The semiconductor layer 37 can function as an etching stopper for preventing the semiconductor layer 32 from being removed at the time of etching of the impurity semiconductor layer 35. Although FIG. 15A shows an example where the semiconductor layer 37 is divided into a right portion and a left portion, part of the semiconductor layer 37 may cover a channel formation region of the semiconductor layer 32.

Furthermore, the semiconductor layer 37 may contain an impurity at a concentration lower than that in the impurity semiconductor layer 35. Thus, the semiconductor layer 37 can function as a lightly doped drain (LDD) region and can suppress a hot channel effect produced when the transistor is driven.

Figure 15B:
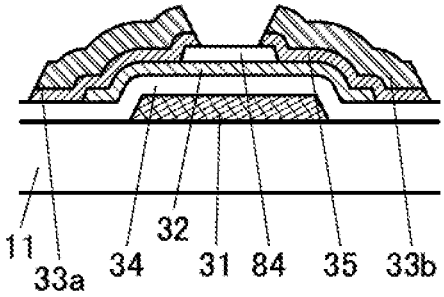

In a transistor illustrated in FIG. 15B, an insulating layer 84 is provided over a channel formation region of the semiconductor layer 32. The insulating layer 84 functions as an etching stopper at the time of etching of the impurity semiconductor layer 35.

Figure 15C:
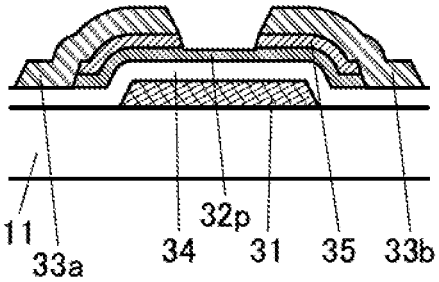

A transistor illustrated in FIG. 15C includes a semiconductor layer 32*p* instead of the semiconductor layer 32. The semiconductor layer 32*p* includes a semiconductor film having high crystallinity. For example, the semiconductor layer 32*p* includes a polycrystalline semiconductor or a single crystal semiconductor. Thus, a transistor having a high field-effect mobility can be provided.

Figure 15D:
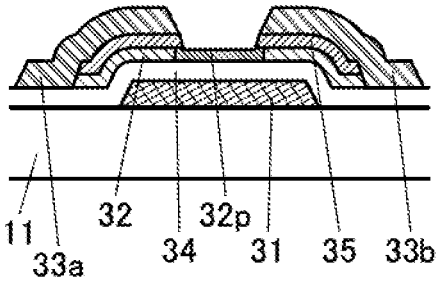

A transistor illustrated in FIG. 15D includes the semiconductor layer 32*p* in a channel formation region of the semiconductor layer 32. For example, the transistor illustrated in FIG. 15D can be formed by irradiating a semiconductor film to be the semiconductor layer 32 with laser light or the like so that crystallization is caused locally. Thus, a transistor having a high field-effect mobility can be provided.

Figure 15E:
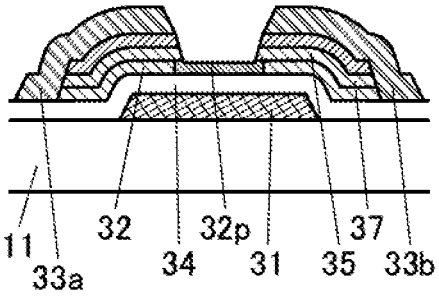

A transistor illustrated in FIG. 15E includes the semiconductor layer 32*p* having crystallinity in a channel formation region of the semiconductor layer 32 of the transistor illustrated in FIG. 15A.

Figure 15F:
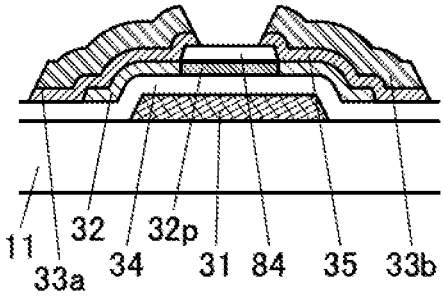

A transistor illustrated in FIG. 15F includes the semiconductor layer 32*p* having crystallinity in a channel formation region of the semiconductor layer 32 of the transistor illustrated in FIG. 15B.

The above is the description of the structure examples of the transistor.

[Components]

The above-described components will be described below.

<Substrate>

A material having a flat surface can be used for the substrate included in the display panel. The substrate on the side from which light from the display element is extracted is formed using a material transmitting the light. For example, a material such as glass, quartz, ceramics, sapphire, or an organic resin can be used.

The weight and thickness of the display panel can be reduced by using a thin substrate. A flexible display panel can be obtained by using a substrate that is thin enough to have flexibility. Alternatively, glass or the like that is thin enough to have flexibility can be used as the substrate. Alternatively, a composite material where glass and a resin material are attached to each other with an adhesive layer may be used.

<Transistor>

The transistor includes a conductive layer functioning as a gate electrode, a semiconductor layer, a conductive layer functioning as a source electrode, a conductive layer functioning as a drain electrode, and an insulating layer functioning as a gate insulating layer.

Note that there is no particular limitation on the structure of the transistor included in the display device of one embodiment of the present invention. For example, a planar transistor, a staggered transistor, or an inverted staggered transistor can be used. A top-gate transistor or a bottom-gate transistor may also be used. Gate electrodes may be provided above and below a channel.

There is no particular limitation on the crystallinity of a semiconductor material used for the transistors, and an amorphous semiconductor or a semiconductor having crystallinity (a microcrystalline semiconductor, a polycrystalline semiconductor, a single crystal semiconductor, or a semiconductor partly including crystal regions) may be used. It is preferred that a semiconductor having crystallinity be used, in which case deterioration of the transistor characteristics can be suppressed.

For example, silicon can be used as a semiconductor in which a channel of the transistor is formed. In particular, amorphous silicon is preferably used as silicon, in which case a transistor can be formed over a large substrate with a high yield, achieving excellent productivity.

Furthermore, silicon having crystallinity such as microcrystalline silicon, polycrystalline silicon, or single crystal silicon can be used. In particular, polycrystalline silicon can be formed at a lower temperature than single crystal silicon and has higher field-effect mobility and higher reliability than amorphous silicon.

Alternatively, a metal oxide may be used for the semiconductor layer of the transistor. A transistor including a metal oxide in a semiconductor layer is known to have a low off-state current. When a transistor with a low off-state current is used as a selection transistor in a pixel, display quality hardly deteriorates even with a long display refresh rate. Accordingly, a still image can be displayed with a reduced display refresh rate, decreasing power consumption. The display controller 104 in Embodiment 1 is suitable for controlling the selection transistor including a metal oxide in the semiconductor layer. The transistor including the metal oxide in the semiconductor layer will be described in detail in Embodiment 4.

The bottom-gate transistor exemplified in this embodiment is preferable because the number of manufacturing steps can be reduced. When amorphous silicon, which can be formed at a lower temperature than polycrystalline silicon, is used for the semiconductor layer, materials with low heat resistance can be used for a wiring, an electrode, or a substrate below the semiconductor layer, resulting in wider choice of materials. For example, an extremely large glass substrate can be favorably used. Meanwhile, the top-gate transistor is preferable because an impurity region is easily formed in a self-aligned manner and variation in characteristics can be reduced. In some cases, the top-gate transistor is particularly preferable when polycrystalline silicon, single crystal silicon, or the like is employed.

<Conductive Layer>

As materials for the gates, the source, and the drain of a transistor, and the conductive layers functioning as the wirings and electrodes included in the display device, any of metals such as aluminum, titanium, chromium, nickel, copper, yttrium, zirconium, molybdenum, silver, tantalum, and tungsten, or an alloy containing any of these metals as its main component can be used. A single-layer structure or a stacked-layer structure including a film containing any of these materials can be used. For example, the following structures can be given: a single-layer structure of an aluminum film containing silicon, a two-layer structure in which an aluminum film is stacked over a titanium film, a two-layer structure in which an aluminum film is stacked over a tungsten film, a two-layer structure in which a copper film is stacked over a copper-magnesium-aluminum alloy film, a two-layer structure in which a copper film is stacked over a titanium film, a two-layer structure in which a copper film is stacked over a tungsten film, a three-layer structure in which a titanium film or a titanium nitride film, an aluminum film or a copper film, and a titanium film or a titanium nitride film are stacked in this order, and a three-layer structure in which a molybdenum film or a molybdenum nitride film, an aluminum film or a copper film, and a molybdenum film or a molybdenum nitride film are stacked in this order. Note that an oxide such as indium oxide, tin oxide, or zinc oxide may be used. Copper containing manganese is preferably used because the controllability of a shape by etching is increased.

As a light-transmitting conductive material that can be used for the gate, source, and drain of the transistor and the conductive layers such as the wirings and electrodes included in the display device, a conductive oxide such as indium oxide, indium tin oxide, indium zinc oxide, zinc oxide, or zinc oxide to which gallium is added, or graphene can be used. Alternatively, a metal material such as gold, silver, platinum, magnesium, nickel, tungsten, chromium, molybdenum, iron, cobalt, copper, palladium, or titanium, or an alloy material containing the metal material can be used. Further alternatively, a nitride of the metal material (e.g., titanium nitride) or the like may be used. In the case of using the metal material or the alloy material (or the nitride thereof), the thickness is set small enough to be able to transmit light. A stacked film of any of the above materials can be used for the conductive layers. For example, a stacked film of indium tin oxide and an alloy of silver and magnesium is preferably used because it can increase the conductivity. They can also be used for conductive layers such as wirings and electrodes included in the display device, and conductive layers (e.g., a conductive layer functioning as a pixel electrode or a common electrode) included in a display element.

<Insulating Layer>

Examples of an insulating material that can be used for the insulating layers include a resin such as acrylic or epoxy resin, a resin having a siloxane bond, and an inorganic insulating material such as silicon oxide, silicon oxynitride, silicon nitride oxide, silicon nitride, or aluminum oxide.

Examples of the insulating film with low water permeability include a film containing nitrogen and silicon (e.g., a silicon nitride film and a silicon nitride oxide film) and a film containing nitrogen and aluminum (e.g., an aluminum nitride film). Alternatively, a silicon oxide film, a silicon oxynitride film, an aluminum oxide film, or the like may be used.

<Liquid Crystal Element>

The liquid crystal element can employ, for example, a vertical alignment (VA) mode. Examples of the vertical alignment mode include a multi-domain vertical alignment (MVA) mode, a patterned vertical alignment (PVA) mode, and an advanced super view (ASV) mode.

The liquid crystal element can employ a variety of modes; for example, other than the VA mode, a twisted nematic (TN) mode, an in-plane switching (IPS) mode, a fringe field switching (FFS) mode, an axially symmetric aligned microcell (ASM) mode, an optically compensated birefringence (OCB) mode, a ferroelectric liquid crystal (FLC) mode, an antiferroelectric liquid crystal (AFLC) mode, an electrically controlled birefringence (ECB) mode, or a guest-host mode can be used.

The liquid crystal element controls the transmission or non-transmission of light utilizing an optical modulation action of a liquid crystal. Note that the optical modulation action of the liquid crystal is controlled by an electric field applied to the liquid crystal (including a horizontal electric field, a vertical electric field, or an oblique electric field). As the liquid crystal used for the liquid crystal element, a thermotropic liquid crystal, a low-molecular liquid crystal, a high-molecular liquid crystal, a polymer dispersed liquid crystal (PDLC), a polymer network liquid crystal (PNLC), a ferroelectric liquid crystal, an anti-ferroelectric liquid crystal, or the like can be used. These liquid crystal materials exhibit a cholesteric phase, a smectic phase, a cubic phase, a chiral nematic phase, an isotropic phase, or the like depending on conditions.

As the liquid crystal material, either a positive liquid crystal or a negative liquid crystal may be used, and an appropriate liquid crystal material can be used depending on the mode or design to be used.

An alignment film can be provided to adjust the alignment of a liquid crystal. In the case where a horizontal electric field mode is employed, a liquid crystal exhibiting a blue phase for which an alignment film is unnecessary may be used. The blue phase is a liquid crystal phase, which is generated just before a cholesteric phase changes into an isotropic phase when the temperature of a cholesteric liquid crystal is increased. Since the blue phase appears only in a narrow temperature range, a liquid crystal composition in which a chiral material is mixed to account for several weight percent or more is used for the liquid crystal layer in order to improve the temperature range. The liquid crystal composition containing a liquid crystal exhibiting a blue phase and a chiral material has a short response time and optical isotropy, which eliminates the need for an alignment process and reduces the viewing angle dependence. Since the alignment film does not need to be provided, rubbing treatment is not necessary; accordingly, electrostatic discharge damage caused by the rubbing treatment can be prevented, reducing defects and damage of a liquid crystal display device in the manufacturing process.

Examples of the liquid crystal element include a transmissive liquid crystal element, a reflective liquid crystal element, and a semi-transmissive liquid crystal element.

In one embodiment of the present invention, a transmissive liquid crystal element is particularly suitable.

In the case where a transmissive or semi-transmissive liquid crystal element is used, two polarizing plates are provided such that a pair of substrates are sandwiched therebetween. Furthermore, a backlight is provided on the outer side of the polarizing plate. The backlight may be a direct-below backlight or an edge-light backlight. The direct-below backlight including a light-emitting diode (LED) is preferably used because local dimming is easily performed to improve contrast. The edge-light backlight is preferably used because the thickness of a module including the backlight can be reduced.

When the edge-light backlight is turned off, see-through display can be performed.

<Coloring Layer>

Examples of a material that can be used for the coloring layers include a metal material, a resin material, and a resin material containing a pigment or dye.

<Light-Blocking Layer>

Examples of a material that can be used for the light-blocking layer include carbon black, titanium black, a metal, a metal oxide, and a composite oxide containing a solid solution of a plurality of metal oxides. The light-blocking layer may be a film containing a resin material or a thin film of an inorganic material such as a metal. Stacked films containing the material of the coloring layer can also be used for the light-blocking layer. For example, a stacked-layer structure including a film containing a material of a coloring layer which transmits light of a certain color and a film containing a material of a coloring layer which transmits light of another color can be employed. It is preferable that the coloring layer and the light-blocking layer be formed using the same material because the same manufacturing apparatus can be used and the process can be simplified.

The above is the description of the components.

At least part of this embodiment can be implemented in combination with any of the other embodiments described in this specification as appropriate.

Embodiment 3

Described in this embodiment are examples of a method of crystallization for polycrystalline silicon which can be used for a semiconductor layer of a transistor and a laser crystallization apparatus.

To form polycrystalline silicon layers having favorable crystallinity, it is preferable that an amorphous silicon layer be provided over a substrate and crystallized by laser irradiation. For example, the substrate is moved while the amorphous silicon layer is irradiated with a linear beam, so that polycrystalline silicon layers can be formed in desired regions over the substrate.

A method using a linear beam achieves relatively high throughput. On the other hand, the method tends to produce variations in crystallinity owing to a change in the output of laser light and a change in the beam profile caused by the output change because laser light is moved relative to a region and is emitted to the region a plurality of times. For example, when a semiconductor layer crystallized by the above method is used for a transistor included in a pixel of a display device, a random stripe pattern due to the variations in the crystallinity is seen in some cases at the time of displaying an image.

The length of the linear beam is ideally greater than or equal to the length of a side of the substrate; however, the length of the linear beam is limited by an output of a laser oscillator and the structure of an optical system. Thus, it is practical to irradiate a large substrate with the laser light by turning back the laser light in a substrate plane. Consequently, there is a region irradiated with the laser light a plurality of times. Since the crystallinity of such a region is likely to be different from that of the other region, display unevenness is sometimes caused in the region.

To avoid such a problem, an amorphous silicon layer formed over a substrate may be crystallized by local laser irradiation. Local laser irradiation easily forms polycrystalline silicon layers with small variation in crystallinity.

Figure 16A:
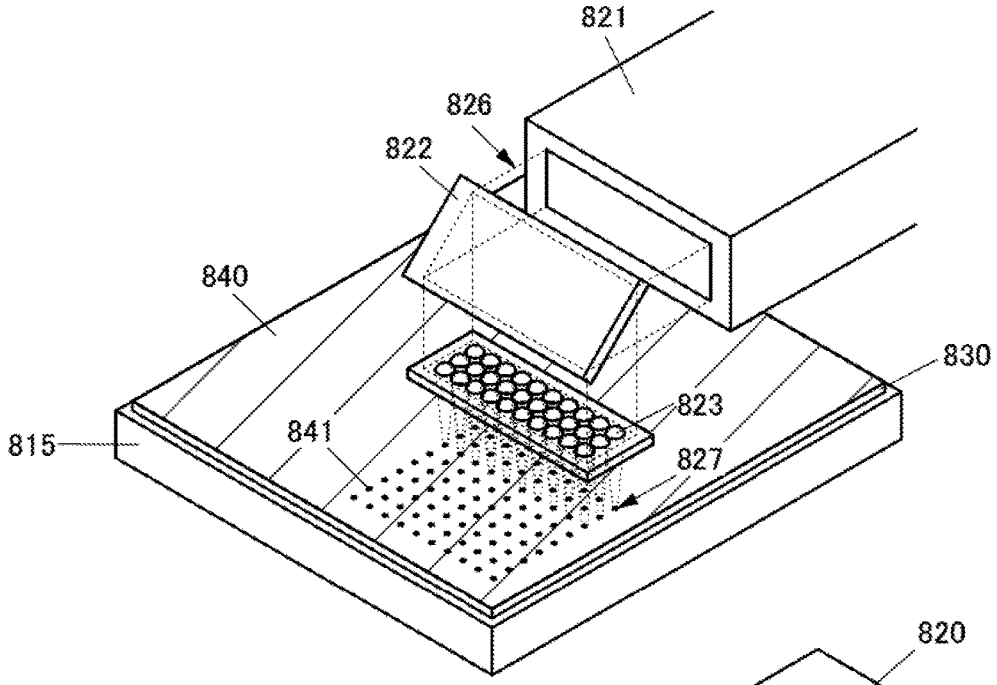
FIGS. 16A and 16B illustrate a laser irradiation method and a laser crystallization apparatus.

FIG. 16A illustrates a method of locally irradiating an amorphous silicon layer formed over a substrate with laser light.

Laser light 826 emitted from an optical system unit 821 is reflected by a mirror 822 and enters a microlens array 823. The microlens array 823 collects the laser light 826 to form a plurality of laser beams 827.

A substrate 830 over which an amorphous silicon layer 840 is formed is fixed to a stage 815. The amorphous silicon layer 840 is irradiated with the plurality of laser beams 827, so that a plurality of polycrystalline silicon layers 841 can be formed at the same time.

Microlenses of the microlens array 823 are preferably provided with a pixel pitch of a display device. Alternatively, they may be provided at intervals of an integral multiple of the pixel pitch. In either of the cases, polycrystalline silicon layers can be formed in regions corresponding to all pixels by repeating laser irradiation and movement of the stage 815 in the X direction or the Y direction.

For example, when the microlens array 823 includes M rows and N columns (M and N are natural numbers) of microlenses arranged with a pixel pitch, laser irradiation is performed at a predetermined start position first, so that M rows and N columns of polycrystalline silicon layers can be formed. Then, the stage 815 is moved by N columns in the row direction and laser irradiation is performed, so that M rows and N columns of polycrystalline silicon layers 841 can be further formed. Consequently, M rows and 2N columns of polycrystalline silicon layers 841 can be obtained. By repeating the steps, a plurality of polycrystalline silicon layers 841 can be formed in desired regions. In the case where laser irradiation is performed by turning back the laser light, the following steps are repeated: the stage 815 is moved by N columns in the row direction; laser irradiation is performed; the stage 815 is moved by M rows in the column direction; and laser irradiation is performed.

Note that even when a method of performing laser irradiation while the stage 815 is moved in one direction is employed, polycrystalline silicon layers can be formed with a pixel pitch by adjusting the oscillation frequency of the laser light and the moving speed of the stage 815 properly.

The size of the laser beam 827 can be an area in which the whole semiconductor layer of a transistor is included, for example. Alternatively, the size can be an area in which the whole channel region of a transistor is included. Further alternatively, the size can be an area in which part of a channel region of a transistor is included. The size can be selected from them depending on required electrical characteristics of a transistor.

Note that in the case of a display device including a plurality of transistors in a pixel, the size of the laser beam 827 can be an area in which the whole semiconductor layer of each transistor in a pixel is included. Alternatively, the size of the laser beam 827 may be an area in which the whole semiconductor layers of transistors in a plurality of pixels are included.

Figure 17A:
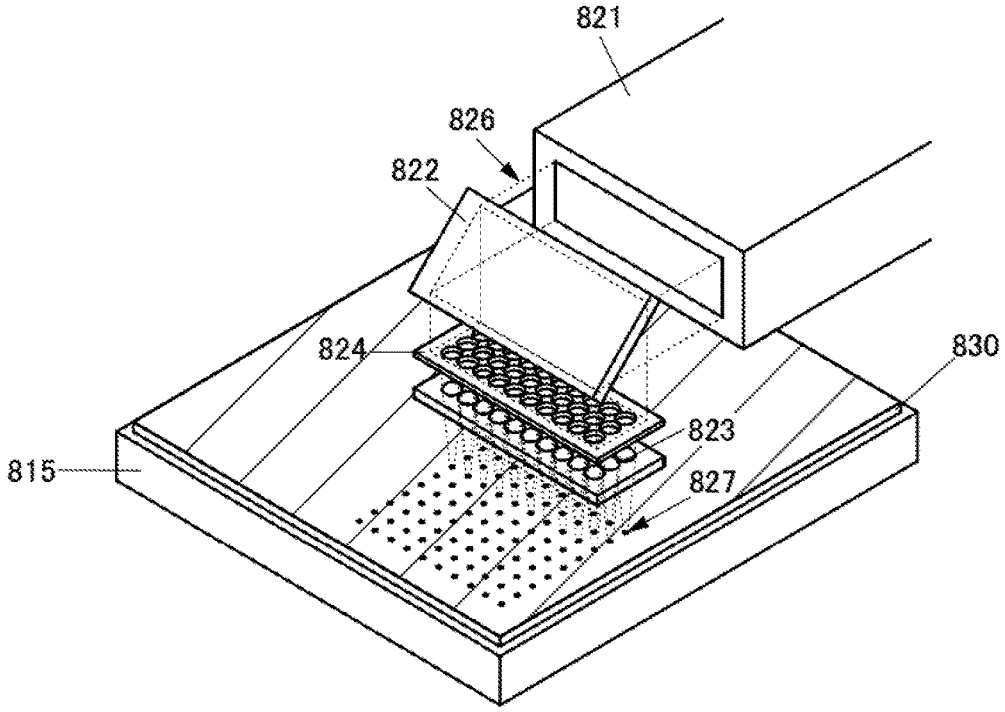
FIGS. 17A and 17B illustrate a laser irradiation method.
Figure 17B:
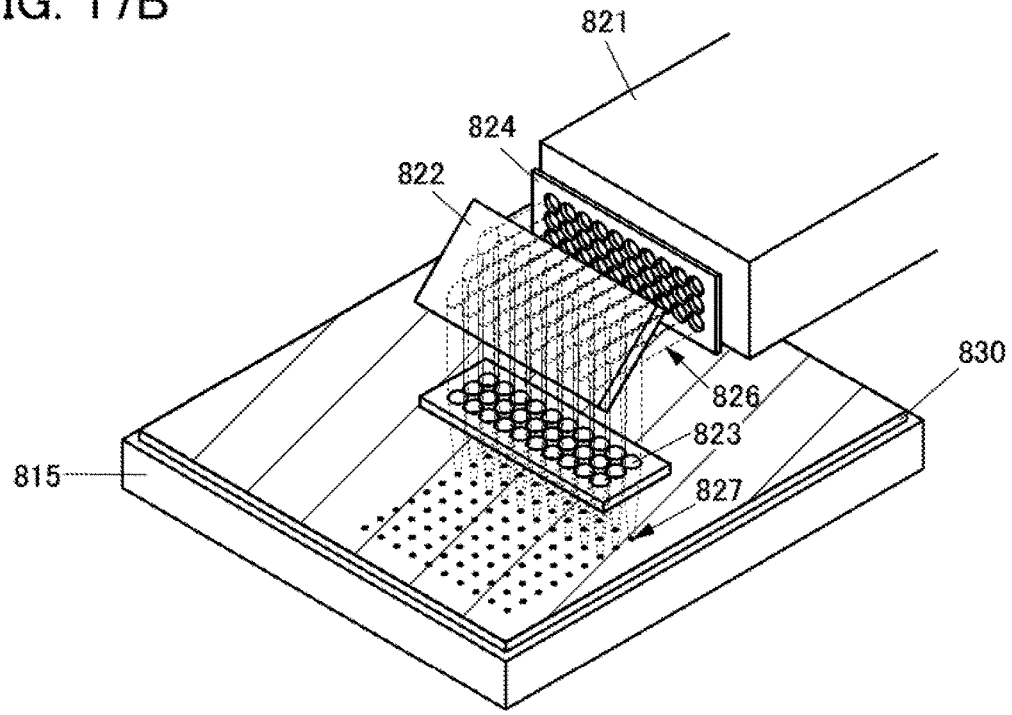

As illustrated in FIG. 17A, a mask 824 may be provided between the mirror 822 and the microlens array 823. The mask 824 includes a plurality of openings corresponding to respective microlenses. The shape of the opening affects the shape of the laser beam 827; as illustrated in FIG. 17A, the laser beam 827 having a circular shape can be obtained in the case where the mask 824 includes circular openings. The laser beam 827 having a rectangular shape can be obtained in the case where the mask 824 includes rectangular openings. The mask 824 is effective in the case where only a channel region of a transistor is crystallized, for example. Note that the mask 824 may be provided between the optical system unit 821 and the mirror 822 as illustrated in FIG. 17B.

Figure 16B:
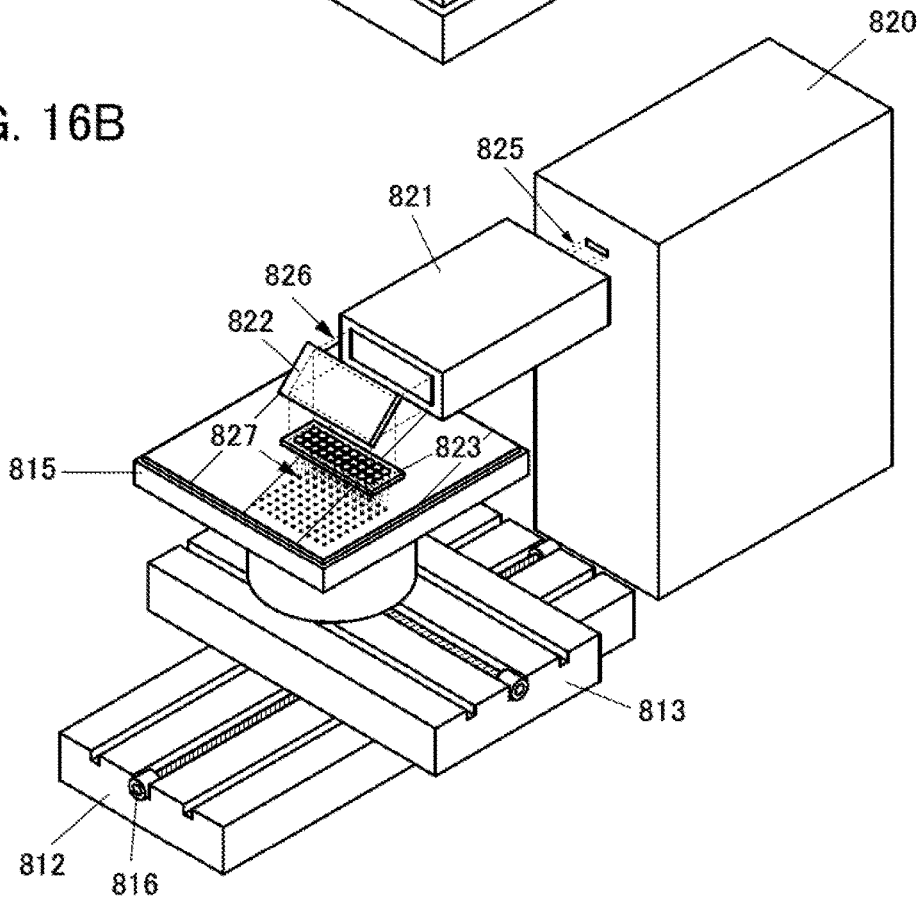

FIG. 16B is a perspective view illustrating a main structure of a laser crystallization apparatus which can be used in the above local laser irradiation step. The laser crystallization apparatus includes a moving mechanism 812, a moving mechanism 813, and the stage 815 which are components of an X-Y stage. The crystallization apparatus further includes a laser oscillator 820, the optical system unit 821, the mirror 822, and the microlens array 823 to shape the laser beam 827.

The moving mechanism 812 and the moving mechanism 813 each have a function of performing reciprocating linear motion in the horizontal direction. As a mechanism for powering the moving mechanism 812 and the moving mechanism 813, a ball screw mechanism 816 driven by a motor can be used, for example. The moving directions of the moving mechanism 812 and the moving mechanism 813 cross orthogonally; thus, the stage 815 fixed to the moving mechanism 813 can be moved in the X direction and in the Y direction freely.

The stage 815 includes a fixing mechanism such as a vacuum suction mechanism and can fix the substrate 830 or the like. Furthermore, the stage 815 may include a heating mechanism as needed. Although not illustrated, the stage 815 may include a pusher pin and a vertical moving mechanism thereof, and the substrate 830 or the like can be moved up and down when being transferred.

The laser oscillator 820 is preferably a pulsed laser, but may be a CW laser as long as it outputs light with a wavelength and intensity suitable for the purpose of processing. Typically, an excimer laser that emits ultraviolet light with a wavelength of 351 nm to 353 nm (XeF), a wavelength of 308 nm (XeCl), or the like can be used. Alternatively, a second harmonic wavelength (515 nm, 532 nm, or the like) or a third harmonic wavelength (343 nm, 355 nm, or the like) of a solid-state laser such as a YAG laser or a fiber laser may be used. A plurality of laser oscillators 820 may be provided.

The optical system unit 821 includes a mirror, a beam expander, a beam homogenizer, or the like, for example, and can homogenize and expand the energy in-plane distribution of laser light 825 emitted from the laser oscillator 820.

As the mirror 822, a dielectric multilayer mirror can be used, for example, and is provided so that the incident angle of the laser light is substantially 45°. The microlens array 823 can have a shape such that a plurality of convex lenses are provided on the top surface or on the top and bottom surfaces of a quartz board, for example.

With the above-described laser crystallization apparatus, polycrystalline silicon layers with small variation in crystallinity can be formed.

At least part of this embodiment can be implemented in combination with any of the other embodiments described in this specification as appropriate.

Embodiment 4

In this specification and the like, a metal oxide means an oxide of metal in a broad sense. Metal oxides are classified into an oxide insulator, an oxide conductor (including a transparent oxide conductor), an oxide semiconductor (also simply referred to as an OS), and the like. For example, a metal oxide used in a semiconductor layer of a transistor is called an oxide semiconductor in some cases. That is, a metal oxide that has at least one of an amplifying function, a rectifying function, and a switching function can be called a metal oxide semiconductor, or OS for short. In addition, an OS FET refers to a transistor including a metal oxide or an oxide semiconductor.

In this specification and the like, a metal oxide including nitrogen is also called a metal oxide in some cases. Moreover, a metal oxide including nitrogen may be called a metal oxynitride.

In this specification and the like, "c-axis aligned crystal (CAAC)" or "cloud-aligned composite (CAC)" may be stated in some cases. Note that CAAC refers to an example of a crystal structure, and CAC refers to an example of a function or a material composition.

In this specification and the like, a CAC-OS or a CAC metal oxide has a conducting function in a part of the material and has an insulating function in another part of the material; as a whole, the CAC-OS or the CAC metal oxide has a function of a semiconductor. In the case where the CAC-OS or the CAC metal oxide is used in a semiconductor layer of a transistor, the conducting function is to allow electrons (or holes) serving as carriers to flow, and the insulating function is to not allow electrons serving as carriers to flow. By the complementary action of the conducting function and the insulating function, the CAC-OS or the CAC metal oxide can have a switching function (on/off function). In the CAC-OS or the CAC metal oxide, separation of the functions can maximize each function.

The CAC-OS or the CAC metal oxide includes components having different bandgaps. For example, the CAC-OS or the CAC metal oxide includes a component having a wide gap due to the insulating region and a component having a narrow gap due to the conductive region. In the case of such a composition, carriers mainly flow in the component having a narrow gap. The component having a narrow gap complements the component having a wide gap, and carriers also flow in the component having a wide gap in conjunction with the component having a narrow gap. Therefore, in the case where the above-described CAC-OS or CAC metal oxide is used for a channel region of a transistor, the transistor in the on state can have a high current drive capability, that is, a high on-state current and a high field-effect mobility.

In other words, the CAC-OS or the CAC metal oxide can also be called a matrix composite or a metal matrix composite.

<Composition of CAC-OS>

Described below is the composition of a CAC-OS applicable to a transistor disclosed in one embodiment of the present invention.

The CAC-OS has, for example, a composition in which elements included in an oxide semiconductor are unevenly distributed. Materials including unevenly distributed elements each have a size of greater than or equal to 0.5 nm and less than or equal to 10 nm, preferably greater than or equal to 1 nm and less than or equal to 2 nm, or a similar size. Note that in the following description of an oxide semiconductor, a state in which one or more metal elements are unevenly distributed and regions including the metal element(s) are mixed is referred to as a mosaic pattern or a patch-like pattern. The region has a size of greater than or equal to 0.5 nm and less than or equal to 10 nm, preferably greater than or equal to 1 nm and less than or equal to 2 nm, or a similar size.

Note that an oxide semiconductor preferably contains at least indium. In particular, indium and zinc are preferably contained. In addition, one or more of aluminum, gallium, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like may be contained.

For example, of the CAC-OS, an In—Ga—Zn oxide with the CAC composition (such an In—Ga—Zn oxide may be particularly referred to as CAC-IGZO) has a composition in which materials are separated into indium oxide ($InO_{X1}$, where X1 is a real number greater than 0) or indium zinc oxide ($In_{X2}Zn_{Y2}O_{Z2}$, where X2, Y2, and Z2 are real numbers greater than 0), and gallium oxide ($GaO_{X3}$, where X3 is a real number greater than 0) or gallium zinc oxide ($Ga_{X4}Zn_{Y4}O_{Z4}$, where X4, Y4, and Z4 are real numbers greater than 0), and a mosaic pattern is formed. Then, $InO_{X1}$ or $In_{X2}Zn_{Y2}O_{Z2}$ forming the mosaic pattern is evenly distributed in the film. This composition is also referred to as a cloud-like composition.

That is, the CAC-OS is a composite oxide semiconductor with a composition in which a region including $GaO_{X3}$ as a main component and a region including $In_{X2}Zn_{Y2}O_{Z2}$ or $InO_{x1}$ as a main component are mixed. Note that in this specification, for example, when the atomic ratio of In to an element M in a first region is greater than the atomic ratio of In to an element M in a second region, the first region has higher In concentration than the second region.

Note that a compound including In, Ga, Zn, and O is also known as IGZO. Typical examples of IGZO include a crystalline compound represented by $InGaO_3(ZnO)_{m1}$ (m1 is a natural number) and a crystalline compound represented by $In_{(1+x0)}Ga_{(1-x0)}O_3(ZnO)_{m0}$ ($-1 \leq x0 \leq 1$; m0 is a given number).

The above crystalline compounds have a single crystal structure, a polycrystalline structure, or a CAAC structure. Note that the CAAC structure is a crystal structure in which a plurality of IGZO nanocrystals have c-axis alignment and are connected in the a-b plane direction without alignment.

On the other hand, the CAC-OS relates to the material composition of an oxide semiconductor. In a material composition of a CAC-OS including In, Ga, Zn, and O, nanoparticle regions including Ga as a main component are observed in part of the CAC-OS and nanoparticle regions including In as a main component are observed in part thereof. These nanoparticle regions are randomly dispersed to form a mosaic pattern. Therefore, the crystal structure is a secondary element for the CAC-OS.

Note that in the CAC-OS, a stacked-layer structure including two or more films with different atomic ratios is not included. For example, a two-layer structure of a film including In as a main component and a film including Ga as a main component is not included.

A boundary between the region including $GaO_{X3}$ as a main component and the region including $In_{X2}Zn_{Y2}O_{Z2}$ or $InO_{X1}$ as a main component is not clearly observed in some cases.

In the case where one or more of aluminum, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like are contained instead of gallium in a CAC-OS, nanoparticle regions including the selected metal element(s) as a main component(s) are observed in part of the CAC-OS and nanoparticle regions including In as a main component are observed in part thereof, and these nanoparticle regions are randomly dispersed to form a mosaic pattern in the CAC-OS.

The CAC-OS can be formed by a sputtering method under conditions where a substrate is not heated, for example. In the case of forming the CAC-OS by a sputtering method, one or more selected from an inert gas (typically, argon), an oxygen gas, and a nitrogen gas may be used as a deposition gas. The ratio of the flow rate of an oxygen gas to the total flow rate of the deposition gas at the time of deposition is preferably as low as possible, and for example, the flow ratio of an oxygen gas is preferably higher than or equal to 0% and less than 30%, further preferably higher than or equal to 0% and less than or equal to 10%.

The CAC-OS is characterized in that no clear peak is observed in measurement using $\theta/2\theta$ scan by an out-of-plane method, which is an X-ray diffraction (XRD) measurement method. That is, X-ray diffraction shows no alignment in the a-b plane direction and the c-axis direction in a measured region.

In an electron diffraction pattern of the CAC-OS which is obtained by irradiation with an electron beam with a probe diameter of 1 nm (also referred to as a nanometer-sized electron beam), a ring-like region with high luminance and a plurality of bright spots in the ring-like region are observed. Therefore, the electron diffraction pattern indicates that the crystal structure of the CAC-OS includes a nanocrystal (nc) structure with no alignment in plan-view and cross-sectional directions.

For example, an energy dispersive X-ray spectroscopy (EDX) mapping image confirms that an In—Ga—Zn oxide with the CAC composition has a structure in which a region including $GaO_{X3}$ as a main component and a region including $In_{X2}Zn_{Y2}O_{Z2}$ or $InO_{X1}$ as a main component are unevenly distributed and mixed.

The CAC-OS has a structure different from that of an IGZO compound in which metal elements are evenly distributed, and has characteristics different from those of the IGZO compound. That is, in the CAC-OS, regions including $GaO_{X3}$ or the like as a main component and regions including $In_{X2}Zn_{Y2}O_{Z2}$ or $InO_{X1}$ as a main component are separated to form a mosaic pattern.

The conductivity of a region including $In_{X2}Zn_{Y2}O_{Z2}$ or $InO_{X1}$ as a main component is higher than that of a region including $GaO_{X3}$ or the like as a main component. In other words, when carriers flow through regions including $In_{X2}Zn_{Y2}O_{Z2}$ or $InO_{X1}$ as a main component, the conductivity of an oxide semiconductor is exhibited. Accordingly, when regions including $In_{X2}Zn_{Y2}O_{Z2}$ or $InO_{X1}$ as a main component are distributed in an oxide semiconductor like a cloud, a high field-effect mobility (μ) can be achieved.

In contrast, the insulating property of a region including $GaO_{X3}$ or the like as a main component is higher than that of a region including $In_{X2}Zn_{Y2}O_{Z2}$ or $InO_{X1}$ as a main component. In other words, when regions including $GaO_{X3}$ or the like as a main component are distributed in an oxide semiconductor, leakage current can be suppressed and favorable switching operation can be achieved.

Accordingly, when a CAC-OS is used for a semiconductor element, the insulating property derived from $GaO_{X3}$ or the like and the conductivity derived from $In_{X2}Zn_{Y2}O_{Z2}$ or $InO_{X1}$ complement each other, whereby a high on-state current ($I_{on}$) and a high field-effect mobility (μ) can be achieved.

A semiconductor element including a CAC-OS has high reliability. Thus, the CAC-OS is suitably used in a variety of semiconductor devices typified by a display.

At least part of this embodiment can be implemented in combination with any of the other embodiments described in this specification as appropriate.

Embodiment 5

In this embodiment, electronic devices of embodiments of the present invention will be described with reference to the drawing.

Each of the electronic devices described below is provided with a display device of one embodiment of the present invention in a display portion. Thus, the electronic devices achieve high resolution. In addition, the electronic devices can achieve both high resolution and a large screen.

The display portion of the electronic device of one embodiment of the present invention can display, for example, an image with a resolution of full high definition, 4K2K, 8K4K, 16K8K, or more. As a screen size of the display portion, the diagonal size can be greater than or equal to 20 inches, greater than or equal to 30 inches, greater than or equal to 50 inches, greater than or equal to 60 inches, or greater than or equal to 70 inches.

Examples of the electronic devices include electronic devices with a relatively large screen, such as a television device, a desktop or laptop personal computer, a monitor of a computer or the like, a digital signage, and a large game machine (e.g., a pachinko machine); a camera such as a digital camera or a digital video camera; a digital photo frame; a mobile phone; a portable game console; a portable information terminal; and an audio reproducing device.

The electronic device or a lighting device of one embodiment of the present invention can be incorporated along a curved inside/outside wall surface of a house or a building or a curved interior/exterior surface of a car.

The electronic device of one embodiment of the present invention may include an antenna. When a signal is received by the antenna, the electronic device can display an image, information, or the like on a display portion. When the electronic device includes the antenna and a secondary battery, the antenna may be used for contactless power transmission.

The electronic device of one embodiment of the present invention may include a sensor (a sensor having a function of measuring force, displacement, position, speed, acceleration, angular velocity, rotational frequency, distance, light, liquid, magnetism, temperature, chemical substance, sound, time, hardness, electric field, electric current, voltage, electric power, radiation, flow rate, humidity, gradient, oscillation, odor, or infrared rays).

The electronic device of one embodiment of the present invention can have a variety of functions such as a function of displaying a variety of information (e.g., a still image, a moving image, and a text image) on the display portion, a touch panel function, a function of displaying a calendar, date, time, and the like, a function of executing a variety of software (programs), a wireless communication function, and a function of reading out a program or data stored in a recording medium.

Figure 18A:
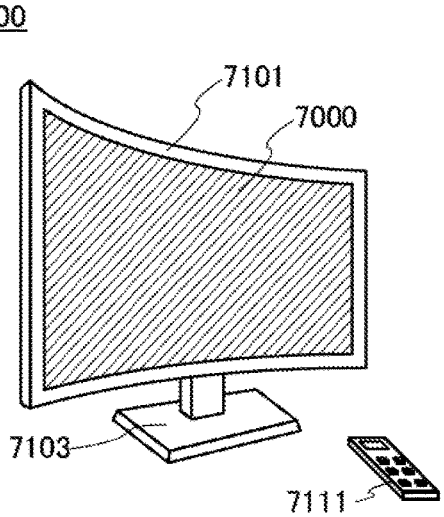
FIGS. 18A to 18F illustrate electronic devices.

FIG. 18A illustrates an example of a television device. In a television device 7100, a display portion 7000 is incorporated in a housing 7101. Here, the housing 7101 is supported by a stand 7103.

The display device of one embodiment of the present invention can be used in the display portion 7000.

The television device 7100 illustrated in FIG. 18A can be operated with an operation switch provided in the housing 7101 or a separate remote controller 7111. Furthermore, the display portion 7000 may include a touch sensor. The television device 7100 can be operated by touching the display portion 7000 with a finger or the like. Furthermore, the remote controller 7111 may be provided with a display portion for displaying information output from the remote controller 7111. With operation keys or a touch panel of the remote controller 7111, channels and volume can be controlled and images displayed on the display portion 7000 can be controlled.

Note that the television device 7100 is provided with a receiver, a modem, and the like. With use of the receiver, general television broadcasting can be received. When the television device is connected to a communication network with or without wires via the modem, one-way (from a transmitter to a receiver) or two-way (between a transmitter and a receiver or between receivers) information communication can be performed.

Figure 18B:
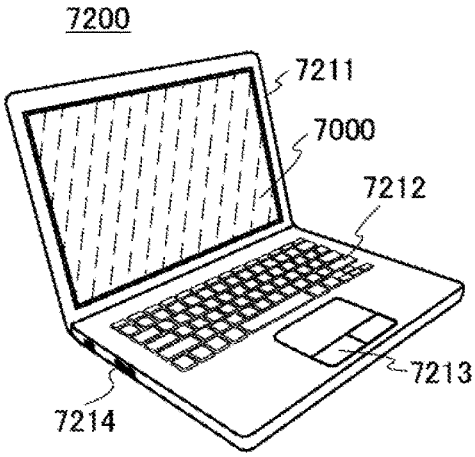

FIG. 18B illustrates a laptop personal computer 7200. The laptop personal computer 7200 includes a housing 7211, a keyboard 7212, a pointing device 7213, an external connection port 7214, and the like. In the housing 7211, the display portion 7000 is incorporated.

The display device of one embodiment of the present invention can be used in the display portion 7000.

Figure 18C:
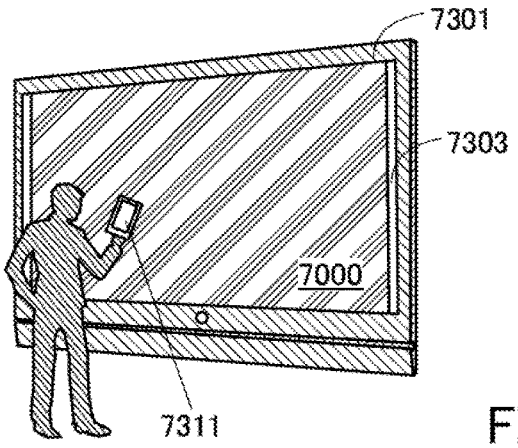
Figure 18D:
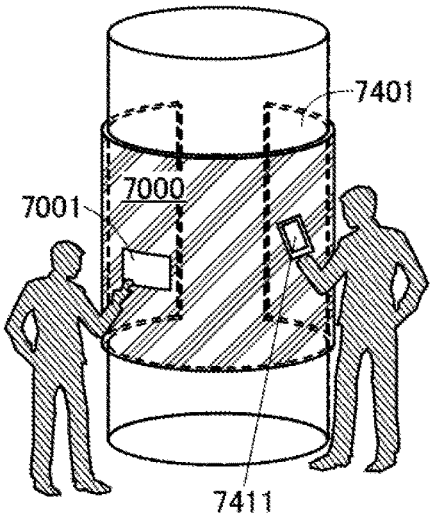

FIGS. 18C and 18D illustrate examples of the digital signage.

A digital signage 7300 illustrated in FIG. 18C includes a housing 7301, the display portion 7000, a speaker 7303, and the like. Also, the digital signage 7300 can include an LED lamp, operation keys (including a power switch or an operation switch), a connection terminal, a variety of sensors, a microphone, and the like.

FIG. 18D illustrates a digital signage 7400 mounted on a cylindrical pillar 7401. The digital signage 7400 includes the display portion 7000 provided along a curved surface of the pillar 7401.

The display device of one embodiment of the present invention can be used in each of the display portions 7000 illustrated in FIGS. 18C and 18D.

A larger area of the display portion 7000 can provide more information at a time. In addition, the larger display portion 7000 attracts more attention, so that the effectiveness of the advertisement can be increased, for example. The display portion 7000 preferably includes a touch panel. By touching part of the display portion 7000, a user can obtain specific information displayed in a display region 7001 of the display portion 7000.

The use of the touch panel in the display portion 7000 is preferable because in addition to display of a still or moving image on the display portion 7000, intuitive operation by a user is possible. In the case where the display device is used for providing information such as route or traffic information, usability can be enhanced by intuitive operation.

Furthermore, as illustrated in FIGS. 18C and 18D, it is preferable that the digital signage 7300 or the digital signage 7400 work with an information terminal 7311 or an information terminal 7411 such as a smartphone a user has through wireless communication. For example, information of an advertisement displayed on the display portion 7000 can be displayed on a screen of the information terminal 7311 or 7411. Moreover, by operation of the information terminal 7311 or 7411, a displayed image on the display portion 7000 can be switched.

Furthermore, it is possible to make the digital signage 7300 or 7400 execute a game with use of the screen of the information terminal 7311 or 7411 as an operation means (controller or touch panel). Thus, an unspecified number of people can join in and enjoy the game concurrently.

Figure 18E:
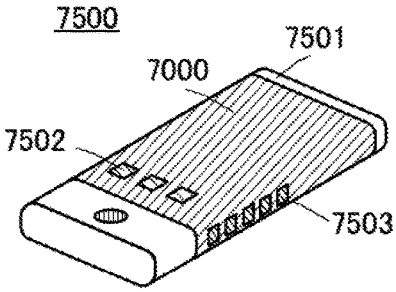

FIG. 18E is a perspective view of a portable information terminal 7500. The portable information terminal functions as, for example, one or more of a telephone set, a notebook, and an information browsing system. Specifically, the portable information terminal can be used as a smartphone. The portable information terminal exemplified in this embodiment is capable of executing, for example, a variety of applications such as mobile phone calls, e-mailing, reading and editing texts, music reproduction, Internet communication, and a computer game.

The portable information terminal 7500 can display characters, image information, and the like on its plurality of surfaces. For example, as illustrated in FIG. 18E, three operation keys 7502 can be displayed on one surface, and information 7503 indicated by a rectangle can be displayed on another surface. The operation keys 7502 displayed on the display portion 7000 may be operated through a touch panel. FIG. 18E illustrates an example in which information is displayed on a side surface of the portable information terminal. Information may be displayed on three or more surfaces of the portable information terminal.

Examples of the information include notification from a social networking service (SNS), display indicating reception of an e-mail or an incoming call, the subject of an e-mail or the like, the sender of an e-mail or the like, the date, the time, remaining battery level, and the reception strength of an antenna. Alternatively, the operation key, an icon, or the like may be displayed in place of the information.

Figure 18F:
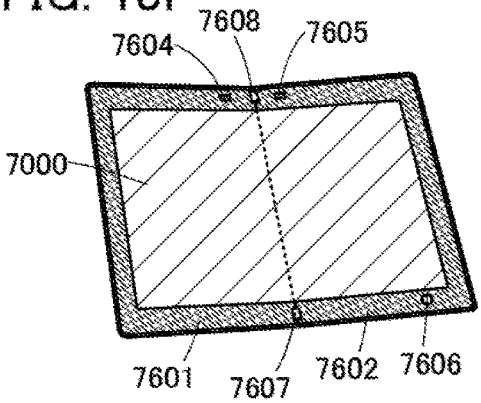

FIG. 18F illustrates a tablet personal computer, which includes a housing 7601, a housing 7602, the display portion 7000 of one embodiment of the present invention, an optical sensor 7604, an optical sensor 7605, a switch 7606, and the like. The display portion 7000 is supported by the housing 7601 and the housing 7602. The display portion 7000 is formed using a flexible substrate and therefore has a function of being bent flexibly.

By changing the angle between the housing 7601 and the housing 7602 with a hinge 7607 and a hinge 7608, the display portion 7000 can be folded such that the housing 7601 and the housing 7602 overlap with each other. Although not illustrated, an open/close sensor may be incorporated so that the above-described angle change can be used as information about conditions of use of the tablet personal computer. The display portion 7000 of one embodiment of the present invention, which is used in the tablet personal computer, can display a high-quality image regardless of the intensity of external light in an operating environment and achieve low power consumption.

At least part of this embodiment can be implemented in combination with any of the other embodiments described in this specification as appropriate.

This application is based on Japanese Patent Application Serial No. 2017-020244 filed with Japan Patent Office on Feb. 7, 2017, the entire contents of which are hereby incorporated by reference.

What is claimed is:

1. A driving method of a display device comprising a display controller and a display panel provided with first to m-th signal lines, first to n-th scan lines, and a plurality of pixels arranged at intersection points of the scan lines and the signal lines, the display controller comprising the steps of:

calculating a first absolute value of a difference value between first display data and second display data and a second absolute value of a difference value between third display data and fourth display data, wherein the first display data is displayed in a first pixel connected to one of the signal lines and (j−1)-th scan line (j is greater than or equal to 2 and less than or equal to n), the second display data is displayed in a second pixel connected to the one of the signal lines and j-th scan line, the third display data is displayed in a third pixel connected to another of the signal lines and the (j−1)-th scan line, and the fourth display data is displayed in a fourth pixel connected to the another of the signal lines and the j-th scan line;

extracting a maximum value from the first absolute value and the second absolute value;

determining a first selection period of the j-th scan line in accordance with the maximum value, from results of a plurality of absolute values, determining that the first display data is the same as the second display data;

concurrently selecting the (j−1)-th scan line and the j-th scan line after determining that the first display data is the same as the second display data; and concurrently updating the first pixel and the second pixel with the first display data, wherein the first pixel and the second pixel are connected to the one of the signal lines.

2. The driving method of the display device according to claim 1, the display controller further comprising the steps of:

dividing the first selection period in accordance with the extracted maximum value;

comparing the first selection period with a second selection period calculated by dividing one frame period by the number of scan lines; and determining that the first selection period is shorter than the second selection period.

3. The driving method of the display device according to claim 1, the display controller further comprising the steps of:

dividing the first selection period in accordance with the extracted maximum value;

comparing the first selection period with a second selection period calculated by dividing one frame period by the number of scan lines; and determining that the first selection period is longer than the second selection period.

4. The driving method of the display device according to claim 1, wherein the display panel comprises a transistor, and wherein the transistor comprises amorphous silicon in a semiconductor layer.

5. The driving method of the display device according to claim 1, wherein the display panel comprises a transistor, and wherein the transistor comprises polycrystalline silicon in a semiconductor layer.

6. The driving method of the display device according to claim 1, wherein the display panel comprises a transistor, and wherein the transistor comprises a metal oxide in a semiconductor layer.

7. The driving method of the display device according to claim 6, wherein the display panel comprises a transistor, and wherein the transistor comprises a backgate.

8. A driving method of a display device comprising a display controller and a display panel provided with first to m-th signal lines, first to n-th scan lines, and a plurality of pixels arranged at intersection points of the scan lines and the signal lines, the display controller comprising the steps of:

calculating an absolute value of a difference value between display data of a (j−1)-th pixel and display data of a j-th pixel in each of the signal lines (j is greater than or equal to 2 and less than or equal to n);

extracting a maximum value from the absolute values;

determining a first selection period of a j-th scan line in accordance with the maximum from results of absolute values, determining that the display data of the (j−1)-th pixel is the same as the display data of the j-th pixel;

concurrently selecting a (j−1)-th scan line and the j-th scan line after determining that the display data of the (j−1)-th pixel is the same as the display data of the j-th pixel; and concurrently updating the (j−1)-th pixel and the j-th pixel with the display data of the (j−1)-th pixel, wherein the (j−1)-th pixel and the j-th pixel are connected to one of the signal lines.

9. The driving method of the display device according to claim 8, the display controller further comprising the steps of:

dividing the first selection period in accordance with the extracted maximum value;

comparing the first selection period with a second selection period calculated by dividing one frame period by the number of scan lines; and determining that the first selection period is shorter than the second selection period.

10. The driving method of the display device according to claim 8, the display controller further comprising the steps of:

dividing the first selection period in accordance with the extracted maximum value;

comparing the first selection period with a second selection period calculated by dividing one frame period by the number of scan lines; and determining that the first selection period is longer than the second selection period.

11. The driving method of the display device according to claim 8, wherein the display panel comprises a transistor, and wherein the transistor comprises amorphous silicon in a semiconductor layer.

12. The driving method of the display device according to claim 8, wherein the display panel comprises a transistor, and wherein the transistor comprises polycrystalline silicon in a semiconductor layer.

13. The driving method of the display device according to claim 8, wherein the display panel comprises a transistor, and wherein the transistor comprises a metal oxide in a semiconductor layer.

14. The driving method of the display device according to claim 13, wherein the display panel comprises a transistor, and wherein the transistor comprises a backgate.

* * * * *